US007149445B2

(12) United States Patent
Bares

(10) Patent No.: US 7,149,445 B2
(45) Date of Patent: Dec. 12, 2006

(54) DETECTION OF BACKGROUND TONER PARTICLES

(75) Inventor: Jan Bares, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 267 days.

(21) Appl. No.: 10/863,707

(22) Filed: Jun. 8, 2004

(65) Prior Publication Data

US 2004/0253014 A1 Dec. 16, 2004

Related U.S. Application Data

(60) Provisional application No. 60/477,481, filed on Jun. 10, 2003.

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS 4,124,287 A 11/1978 Bean et al.
4,553,033 A 11/1985 Hubble, III et al. ..... 250/353
4,750,838 A 6/1988 De Wolf et al. ..... 356/445
4,924,263 A 5/1990 Bares
4,999,673 A 3/1991 Bares
5,084,735 A 1/1992 Rimai et al.
5,204,538 A 4/1993 Genovese ..... 250/571
5,214,471 A 5/1993 Bares
5,370,961 A 12/1994 Zaretsky et al. ..... 430/126
5,933,680 A * 8/1999 Nishimura ..... 399/49
6,184,911 B1 2/2001 Tombs ..... 347/117

* cited by examiner

*Primary Examiner*—William J. Royer
(74) *Attorney, Agent, or Firm*—Lawrence P. Kessler

(57) ABSTRACT

Apparatus and method to detect and measure, in a non-image area on a toner-image-bearing member, a low coverage of toner particles relating to a background coverage of toner particles in an image frame, and in particular, to detect and measure by an optical detector a low toner coverage in excess of a threshold coverage or a pre-selected coverage and thereby produce a signal, e.g., a process control signal. Such a process control signal can be used to adjust the operating parameters of a process in a subsystem, such as a toning process or a photoexposure process. In preferred embodiments, synchronous detection is used to extract a signal having a magnitude proportional to the low toner coverage representative of the background coverage of toner particles.

15 Claims, 10 Drawing Sheets

DETECTION OF BACKGROUND TONER PARTICLES

CROSS REFERENCE TO RELATED APPLICATION

Reference is made to and priority claimed from U.S. Provisional Application Ser. No. 60/477,481, filed Jun. 10, 2003, entitled DETECTION OF BACKGROUND TONER PARTILCES.

FIELD OF THE INVENTION

The invention relates to electrostatography and to an apparatus and method to detect a low coverage of toner particles on a toner-image-bearing member, and in particular to detect or monitor background toner having a low coverage in excess of a threshold coverage and thereby produce a signal.

BACKGROUND OF THE INVENTION

An exemplary modular color printer includes a number of tandemly arranged electrophotographic image-forming modules (see for example, U.S. Pat. No. 6,184,911). Such a printer includes two or more single-color image forming stations or modules arranged in tandem and an insulating transport web for moving receiver members such as paper sheets through the image forming stations, wherein in each module a single-color toner image is transferred from an image carrier, i.e., a photoconductor (PC) or an intermediate transfer member (ITM), to a receiver held electrostatically or mechanically to the transport web, and the single-color toner images from each of the two or more single-color image forming stations are successively laid down in registry one upon the other to produce a plural or multicolor toner image on the receiver. The receiver carrying the unfused plural image is then sent to a fusing station where the multicolor toner image is thermally fixed or fused to the receiver using heat and/or pressure in known fashion.

In a digital electrophotographic copier or printer, a uniformly charged PC surface may be exposed pixel by pixel using an electro-optical exposure device including light emitting diodes, such as for example described by Y. S. Ng et al., Imaging Science and Technology, 47th Annual Conference Proceedings (1994), pages 622–625.

A widely practiced method of improving toner transfer is by use of so-called surface treated toners. As is well-known, surface treated toner particles have adhered to their surfaces sub-micron particles, e.g., of silica, alumina, titania, and the like (so-called surface additives or surface additive particles). Surface treated toners generally have weaker adhesion to a smooth surface than untreated toners, and therefore surface treated toners can be electrostatically transferred more efficiently from a PC or an ITM to another member.

As disclosed in the Rimai et al., U.S. Pat. No. 5,084,735, and in the Zaretsky and Gomes, U.S. Pat. No. 5,370,961, use of a compliant ITM roller coated by a thick compliant layer and a relatively thin hard overcoat improves the quality of electrostatic toner transfer from an imaging member to a receiver, as compared to a non-compliant intermediate roller.

As is well-known, a toner image may be formed on a PC, preferably a photoconductive roller, by the sequential steps of uniformly charging the PC surface in a charging station using a corona charger, exposing the charged PC to a pattern of light in an exposure station to form a latent electrostatic image, and toning the electrostatic image in a development station to form a toner image on the PC surface. The exposing pattern of light has a one-to-one correspondence with an original image, which original image is for reproduction or visualization as the toner image. The electrostatic image may be developed using discharge area development (DAD) in which charged toner particles having a same polarity as that of the surface corona charges are attracted to exposed areas of the PC. Alternatively, charged area development (CAD) may be used in which the toner particles have an opposite polarity to the corona charges. Preferably, discharge area development is used in a printing machine using a digital exposure device. After development, the toner image can be transferred in a transfer station directly to a receiver member, e.g., a paper sheet, or it may first be transferred to an ITM, preferably an intermediate transfer roller, and subsequently transferred to the receiver.

A background area is defined as a macroscopic area on an imaging member, which macroscopic area corresponds to an area in the original image in which there is no image information, e.g., in which the density is substantially zero. Such an original image can be a color separation image. Ideally there is no toner deposition in a background area. In order to keep a background area on the PC substantially free of toner, the development electric field in the development station typically has a polarity such as to locally repel nominally charged toner particles in the background area. This reverse bias field in a background area is determined by the bias potential applied in the development station.

In charged area development (CAD) of a toner image, a $D_{max}$ area having a maximum amount of toner lay down corresponds to an area having substantially zero photoexposure, i.e., at a potential $V_0$, whilst a background area in CAD corresponds to an area of high photoexposure in which the surface potential has been discharged by the exposure device to a voltage below a threshold voltage for toning, which threshold voltage has a magnitude smaller than the magnitude of the applied bias potential, $V_b$. Thus in an imaging area the onset of toning at threshold occurs despite a repelling electric field. In CAD practice, a background area is an area in which the amount of photoexposure is sufficient to drive the magnitude of the surface potential below the magnitude of $V_b$, i.e., intermediate between $V_b$ and the residual voltage which is the limiting surface potential produced by very large photoexposures.

On the other hand, in discharged area development (DAD) the areas of maximum photoexposure by the photodischarge device correspond to $D_{max}$ areas, and a DAD background area is an area of low photoexposure (which can be substantially zero photoexposure). As in a CAD process, in a DAD process the threshold surface potential for toning in an imaging area occurs when there is a reverse bias electric field. As is well known, in the DAD case the threshold surface potential for toning has a magnitude intermediate between $V_0$ and the applied bias potential, $V_b$.

The optimal situation for both CAD and DAD processes typically occurs when a development sump contains fresh developer, i.e., when the toner particles are optimally triboelectrically charged by carrier particles that have had relatively little or no wear, so that the background areas remain substantially clean during the development process.

The ability to charge fresh toner particles in a toning station decreases with developer age, and also depends on the dispense rate of fresh toner added per unit time to the developer so as to match the toner takeout rate. Developer wear generally manifests itself by slowed charging rate and/or by inability to charge freshly added toner to a desired level. As a result, a developer mixture contains some weakly charged or uncharged toner particles, and in an extreme case an aged developer can contain wrong-polarity toners having a net charge opposite to that of suitably charged toner particles. Such weakly charged, uncharged, or wrong-polarity toners tend to be disadvantageously deposited in background areas, and can cause unacceptably large background toner concentrations.

As the number of weakly charged, uncharged, or wrong-polarity toners in a developer increases as the developer ages, the result is a movement of the toe of a development curve to lower development voltages. Ultimately, such toner particles are deposited in background areas despite the reverse biasing which locally provides a repelling electric field.

Exemplary FIG. 1A demonstrates this situation for the case of charged area development using for example a magnetic brush apparatus, where for ease of illustration only, the PC surface is taken to be charged positively (giving positive surface potentials) and negative toner particles develop the electrostatic image. Thus in this exemplary CAD process the surface is initially charged to a positive voltage $V_0$ (zero photoexposure) and photodischarged to some potential $V_{exp}$, as depicted schematically by the curve labeled "1" in the left hand graph of FIG. 1A where $V_{exp}$ is plotted as a function of photoexposure. At very large photoexposure the surface potential levels off at a residual potential, $V_r$. The graph depicted on the right hand side of FIG. 1A schematically shows a corresponding plot of developed mass per unit area (DMA) as a function of the development voltage when using a fresh developer, where DMA is a quantitative measure of toner coverage. For zero exposure, the coverage is greatest with developed mass per unit area equal to $DMA_{max}$, and for exposure corresponding to threshold, $E_{th}$, the DMA is zero. In the present example, the development voltage is defined as $(V_{exp}-V_b)$ and is controlled by the bias level $V_b$, with $V_{exp}>V_b$. The threshold photodischarge voltage for toning, $V_{th}$, determines the onset of the toe of the development curve, which occurs for a threshold development voltage $V_a=(V_{th}-V_b)$. $V_a$ is negative in this example, i.e., toner particles are typically deposited even when a weak reverse bias electric field exists during development, owing to the presence of non-electrostatic forces, as is well known. However, for all potentials below $V_b$, the development electric field is in a direction to attract wrong-sign toners (i.e., toners having a net positive charge in the present case). The difference of potential $(V_{th}-V_r)$ is commonly known as the background latitude window. Using properly charged toner particles, a development voltage, $V_{bkg}$, produced by a photoexposure, $E_{bkg}$, results in a clean background, as does any other development voltage which is more negative than $V_{bkg}$.

Exemplary FIG. 1B (corresponding to FIG. 1A) schematically shows developed mass per unit area plotted as a function of development voltage in the threshold or toe region. The lower curve labeled "acceptable developer" is essentially the same as the threshold portion of the curve in the right hand portion of FIG. 1A. The curve labeled "marginal developer" shows the effect of a certain degree of developer aging, where the threshold development voltage has shifted from $V_a$ to a more negative value, $V_{a'}$. Ultimately, with an even older developer, the threshold development voltage will become more negative than $V_{bkg}$, which means that toner will be disadvantageously deposited in background areas.

Exemplary figures (not shown), corresponding to FIGS. 1A and 1B can be constructed for DAD development using a magnetic brush apparatus (see above), where $V_b$ is set close to $V_0$ rather than close to $V_r$, $V_{th}$ is positioned between $V_0$ and $V_b$, and the DMA declines as photoexposure increases.

Returning to FIG. 1A, the photodischarge curve labeled "2" schematically shows the effect of photoconductor aging or fatigue. Larger exposures are required to produce a given amount of photodischarge, and the residual voltage is higher. This reduces the magnitude of the background latitude window, with the result as sketched that even with fresh developer the background areas may not be clean for an exposure equal to $E_{bkg}$. Thus fatigue of a photoconductor can produce a degradation of the background areas similar to that caused by aging of the developer. Thus early warning of photoconductor fatigue can be obtained by use of the subject invention. As will be seen below, a result of photoconductor fatigue can in certain cases be distinguished from a result caused by aging of a developer.

The Bean et al., U.S. Pat. No. 4,124,287, discloses forming an image wise non-uniform charge pattern on a photoconductor surface and a contacting the surface with uncharged marking particles. Briefly, a patch containing a pattern of alternating charge density preferably of high spatial frequency can be produced by any of a number of ways as disclosed in U.S. Pat. No. 4,124,287, e.g., via photoexposure of a thin, charged, photoconductive layer or by moving a photoconductor surface under an AC corona charger having a slit for passage of the corona ions. Contacting a resulting charge pattern with uncharged particles results in polarization of the particles in the highly non-uniform electric fields associated with the charge pattern, with the result that the polarized particles are attracted to the surface by the dielectrophoretic forces. Calculations of such polarization forces exerted on a spherical toner particle above a periodically charged photoreceptor are given for example by I. Chen, *Journal of Photographic Science and Engineering* Vol. 26, page 153 (1982). A discussion of a similar phenomenon for magnetic toners in a highly uniform magnetic field is given for example in an article by J. Bares, *Journal of Photographic Science and Engineering* Vol. 28 (3), pages 111–118 (1984).

An optoelectronic circuit for measuring the optical density of a toned test patch in comparison with an untoned area is disclosed by the DeWolf et al., U.S. Pat. No. 4,750,838. A phototransistor is used to measure light reflected from the test patch. An exemplary circuit is described for measuring optical densities in a range 0.5–1.5. However, as mentioned (column 6, line 66 of the DeWolf et al. patent) the technique is capable of measuring optical densities in a range 0.0–1.5.

The Bares patent, U.S. Pat. No. 4,924,263, discloses use of a synchronous detection circuit to measure a surface concentration (or coverage) of magnetized or magnetizable toner particles on a photoconductor, and to generate there from a resulting control signal. A patch image in the form of a bar pattern made from parallel equi-spaced strips is created on the photoconductor surface via corona charging, photoexposure, and development in standard fashion. The bars of the bar pattern are formed perpendicular to the direction of motion of the photoconductor surface. As the bar pattern moves past a magnetic read head adjacent to the PC surface, an alternating magnetic field is sensed by the read head so as to produce an alternating voltage which when passed through a low pass filter (having a time constant, $T_0$) produces a read head AC voltage signal. Simultaneously, a beam of light is bounced off the moving bar pattern and the reflected beam is passed into an optical detector, which monitors changes in reflectivity as the bars move past. An alternating reflection intensity sensed by the optical detector produces an alternating voltage which when passed through a low pass filter (having a similar time constant, $T_0$) produces a reference AC voltage signal. After any suitable pre-amplication(s) the read head AC voltage signal and the reference AC voltage signal, which are in phase with one another, may be represented respectively as $(V_0)\ G(t/T_0)\ \mathrm{Cos}(\omega t)$ and $(\mathrm{Vor})\ G(t/T_0)\ \mathrm{Cos}(\omega t)$, where $\omega$ is $2\pi$ cycles per unit time and $G(t/T_0)$ is a gate function which relates to the number of bars scanned. The magnitude of the voltage $V_0$ is proportional to the coverage of toner in the bar pattern. The read head AC voltage signal and the reference AC voltage signal are multiplied together in a signal multiplier device so as to produce a multiplied signal of the form $(V_0)(\mathrm{Vor})\ G(t/T_0)\ \mathrm{Cos}^2(\omega t)$, which is identically equal to $0.5(V_0)(\mathrm{Vor})\ G(t/T_0)(1+\mathrm{Cos}(2\omega t))$. After passage of this multiplied signal through a low pass filter, the DC component is obtained as an output control signal equal to $0.5(V_0)(\mathrm{Vor})\ G(t/T_0)$. This output control signal, being proportional to the voltage reading of the magnetic read head, can then be used to regulate various processing stations in a reproduction machine using a magnetic ink character recognition format.

As disclosed in Bares, U.S. Pat. No. 4,999,673, a processing station in an electrophotographic printing machine, is controlled by monitoring a toned test patch on a photoconductor, using an infrared densitometer. The test patch, e.g. in the form of equi-spaced strips, preferably (but not necessarily) perpendicular to the direction of motion of the photoconductor, is located in an interframe (interimage) area on the photoconductor. The test patch can be representative of a portion of an image frame, such that an output signal from the infrared densitometer can be used to regulate a processing station, e.g., so as to adjust set points for charging, exposing or toning in the image frame.

A densitometer for optically detecting a reflectance signal which is inversely proportional to a coverage of a color toner in a test area on a photoconductor surface is disclosed in Genovese, U.S. Pat. No. 5,204,538. The densitometer is used to measure reflection optical density sequentially from two different sources of radiation, i.e., using alternately operating near infrared light sources and a single photodiode detector to detect the rays from each source as reflected from the test area located in an interframe (interimage) area on a photoconductive belt of an electrophotographic color printing machine. The test area is created in a similar manner as that of an adjacent image area on the photoconductor, i.e., using similar set points for charging of the photoconductor and developing of the respective electrostatic images. The photoexposure device for exposing the test area is separate from the photoexposure device for exposing the adjacent image area. One of the light sources in the densitometer, e.g. a primary LED, is focused on to the test area so that reflected light from that portion of the photoconductor not covered by toner (R) plus the scattered light (S) from the toner particles in the test area are simultaneously detected by the photodiode detector, i.e., as (R+S). The second source is preferably an array of more than one secondary LED such that each secondary LED is located off axis from the primary LED, and only scattered reflected light (S) reaches the detector. Thus alternating signals of (R+S) and S are obtained, so that R can be extracted electronically. The quantity R is inversely proportional to the toner coverage being measured in the test area. The densitometer is capable of measuring toner coverages over a wide gamut, from low to high coverage (see FIG. 3 of the Genovese patent). In view of the AC signal produced by the alternation of the primary and secondary light sources, the resulting AC voltage signal is conducive to synchronous detection and integration circuitry, which can be used to extract minute signals from a noisy background.

The above-cited patents are not primarily concerned with detection and/or monitoring of background toner particles per se. For example, Bares, U.S. Pat. No. 4,924,263, does not specifically disclose application to low coverages of toner in background areas, and discusses only magnetized or magnetizable toners. However, low coverages of toner particles can be measured according to U.S. Pat. Nos. 4,750,838 and 5,204,538.

Apparatus for measuring background toner on a receiver sheet is disclosed in Bares, U.S. Pat. No. 5,214,471. A raster input scanner such as a CCD device is used to scan a toned area in a print (after transfer from a photoconductor to the receiver) and thereby to measure background toner concentration thereon, essentially by counting background toner particles on a pixel-by-pixel basis. Suitable pattern recognition algorithms can be used to distinguish indicia such as text and/or objects having a toner lay down greater than a pre-selected threshold lay down. The number of particles counted by such a CCD device produces a control signal which can be used to regulate various processing stations in an electrophotographic machine, or which can be used to generate a service call.

While the apparatus of Bares, U.S. Pat. No. 5,214,471, is capable of measuring low coverages of background toner, it is relatively expensive and requires high-speed data processing so as to be able to count all relevant pixels in an image on a moving photoconductor surface.

SUMMARY OF THE INVENTION

The invention is directed to an apparatus and method to detect and measure a low coverage of toner particles located on a toner-image-bearing member in an electrostatographic machine, such as for example a toned photoconductive imaging member, an intermediate transfer member bearing a toner image, and a receiver member bearing a toner image created on an imaging member and transferred thereto. In particular, the invention concerns detecting and measuring a low coverage of toner particles in excess of a threshold coverage or a pre-selected coverage so as to produce a signal, e.g., a process control signal. Such a process control signal can for example be used to adjust the operational parameters of a process in a subsystem of the electrostatographic machine, such as for example a toning process or a photoexposure process.

The invention is especially useful for detecting a low coverage of toner particles relating to a background coverage of toner particles, such as may be deposited during development in background areas in a toner image located in an image frame on an imaging member. Under most conditions it is impractical to measure such a background coverage directly. According to the invention, accurate measures of background toner levels on a toner-image-bearing member can be obtained in surrogate fashion by utilizing a test patch or test area located outside of the image frame in a non-image area such as an interframe area. The test area includes sub-areas in which conditions of formation of a corresponding toned image frame on the toner-image-bearing member are mimicked, i.e., these sub-areas are toned to coverages closely representative of background coverages of toner particles in the image frame. An important feature of the invention is an ability to provide an early warning of a type of developer failure in which some toner particles are not fully charged in the development station, or have net charge of the wrong polarity.

In one embodiment, a test area latent image on a moving photoconductor surface is created in the form of alternating strips such that toning at a background level is prevented in one set of strips, and allowed in the other set of strips. The strips are aligned perpendicular to the direction of motion of the photoconductor. After development, the pattern of toned strips passing under a small aperture detector such as for example a bar code reader results in an easily detectable AC signal.

In a preferred embodiment having higher sensitivity and superior signal-to-noise, synchronous detection is employed. A test patch similar to that of the previous embodiment is used in conjunction with a separate reference patch containing high coverage reference toner strips, with the reference patch being read by a second detector to provide a reference signal. In a synchronous detection circuit, the test patch signal or control signal and the reference signal are electronically multiplied, the AC component is removed by a low-pass filter, and a DC output is a measure of the coverage of toner in the low coverage toned bars of the test patch.

In another preferred embodiment utilizing synchronous detection and just one detector, a toned test patch includes both high coverage reference toner strips as well as low coverage control toned strips in a composite toner patch image. The high coverage reference-toned strips have a relatively low spatial frequency, and interspersed between the reference-toned strips are sets of equally spaced control toned strips having a spatial frequency that is a multiple of the spatial frequency of the reference-toned strips. Movement of the composite toner patch image past a detector produces a composite AC signal, which is input to a synchronous detection circuit having a DC output with an amplitude proportional to the coverage of the control toned strips.

In yet another preferred embodiment utilizing synchronous detection, the reference signal is not obtained from a toned patch area, but instead is obtained from encoder signals permitting good synchronization with the reference-toned strips located in the test area. Such encoder signals, which accurately monitor photoconductor positioning, can for example be obtained from equi-spaced perforations located along an edge of a photoconductor web, from image registration marks, and so forth.

In still yet another preferred embodiment, a test area latent image on an imaging member includes strips, which repel well-charged toner particles under the applied conditions in the development station, and these strips alternate with strips of a different charge density, which also repel well-charged toner particles. The inhomogeneous electric fields acting between the alternating strips external to the imaging member produce polarization forces on uncharged toner particles, or on particles having a very low charge. These short-range polarization forces can cause nearby uncharged or low charged toner particles to be attracted to the surface of the imaging member, resulting in a set of toned strips having double the frequency of the test area latent image. The configuration of this embodiment amplifies the difference between no toning and low charge toning so as to make the reflectance change larger and thus readily detectable by an installed wide aperture densitometer.

In still a further preferred embodiment, a test image is formed in an image frame on a receiver member via electrostatic transfer from an imaging member, the test image including a plurality of color sub-images lined up so as to successively pass under a detector. Each color sub-image includes respective control toned strips and reference-toned strips. An AC signal generated by the detector as each color sub-image passes the detector is sent to a synchronous detection circuit so as to produce a respective DC output having an amplitude proportional to a respective low coverage of toner in the respective control toned strips.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Figure 1A:
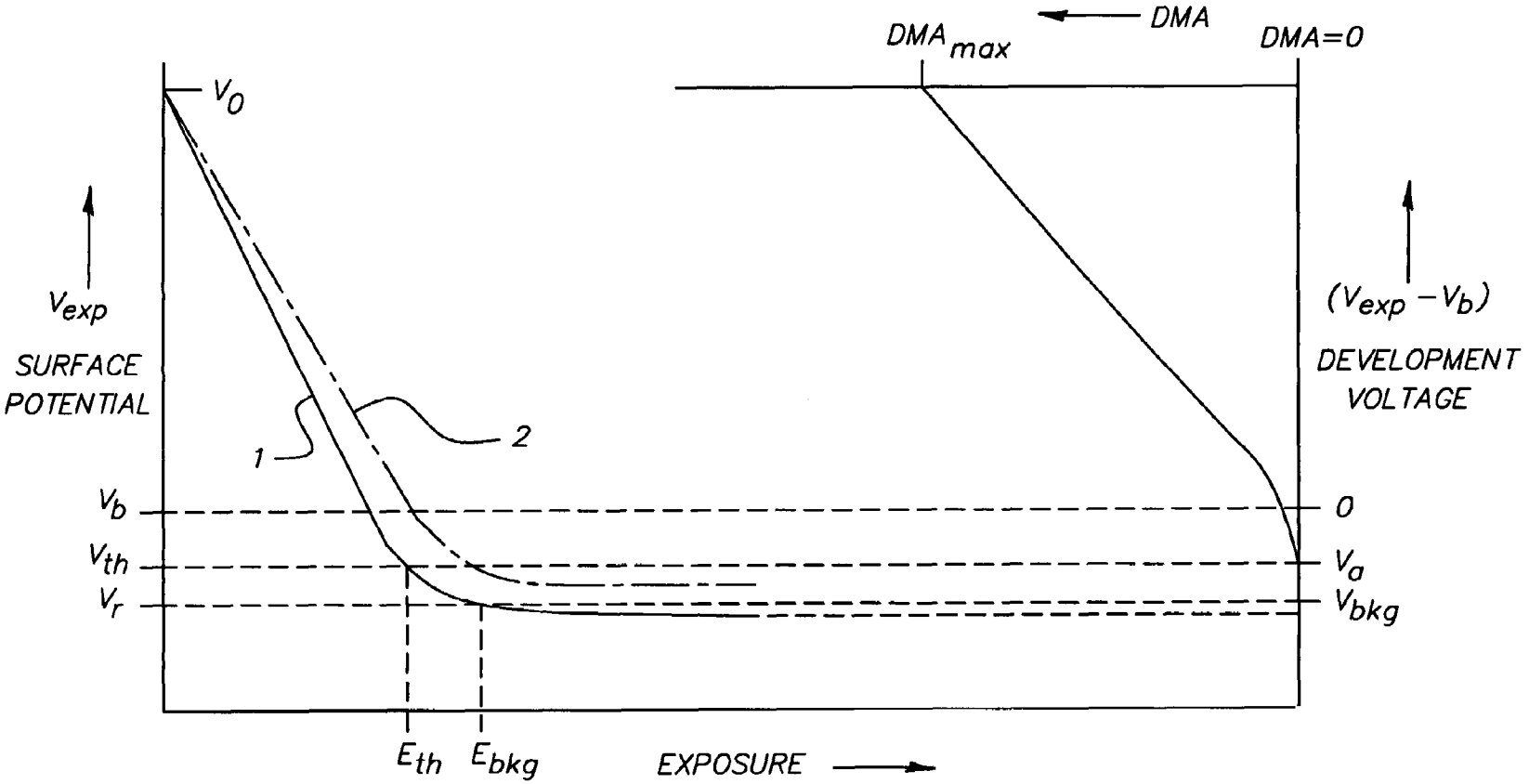
FIG. 1A is an exemplary illustration of a relationship between a graph of photodischarge of a photoconductor versus photoexposure and a graph of toner mass lay down as a function of development voltage.

The invention is directed to detecting and measurement of a low coverage of toner particles in a toner image located on a toner-image-bearing member. The invention is primarily for use in electrostatography but is not restricted thereto. A toner-image-bearing member includes an imaging member in the form of a roller or web bearing a toner image, an intermediate transfer member in the form of a roller or web bearing a toner image, and a receiver member such as a paper sheet or web bearing a toner image created on an imaging member and transferred thereto. An imaging member includes a photoconductive imaging member, an electrographic imaging member, or any member on which a primary toner image is formed for subsequent transfer to a receiver member.

In particular, the invention describes apparatus and methods for detecting and measuring a low coverage of toner particles in excess of a threshold coverage so as to produce a signal, e.g., a process control signal. Such a process control signal can, for example, be used in an electrostatographic machine to adjust the parameters of a process in a subsystem, such as for example a toning process or a photoexposure process.

The invention is especially useful for detecting a low coverage of toner particles relating to a background coverage of toner particles. A background coverage of toner particles may be deposited during development in background areas in a toner image located in an image frame on an imaging member. Under most conditions it is impractical to measure such a background coverage of toner particles directly. According to the invention, accurate measures of background toner levels on a toner-image-bearing member can be obtained in surrogate fashion by utilizing a test patch or test area located outside of the image frame. The test area includes sub-areas in which conditions of formation of a corresponding toned image frame on the toner-image-bearing member are mimicked, i.e., these sub-areas are toned to coverages closely representative of background coverages of toner particles in the image frame. An important feature of the invention is an ability to provide an early warning of a type of developer failure in which some toner particles are not fully charged in the development station.

In one embodiment, very low toner coverages are detected and measured in a test area on an imaging member, which imaging member can be a photoconductor or a dielectric member for use in electrographic recording. The test area is preferably not included in an image frame wherein is recorded information relating to an electrostatographic print, e.g., color separation information. Toner images formed in image frames are transferred to a receiver member, e.g., a receiver sheet moving through a modular electrophotographic color printing machine. In this embodiment, a latent image in the form of an electrostatic image is created via image-wise photoexposure in the test area, which electrostatic image is developed by toner particles deposited by a development station. The toner particles in the resulting test area toner image on the imaging member are typically color toner particles, which can be optically detected on the imaging member by a read head prior to passage of the test area through a transfer station. After detection of a low coverage of a given color toner in the test area and a corresponding signal generated via output from the read head, the signal in the form of a control signal can be used for adjusting the set points for creating a toner image having toner particles of the same color as the toner in the test area, e.g., so as to reduce unwanted background density of the same color toner in a corresponding image frame upstream of the test area. In an alternative embodiment, the toner particles in a toned test area are transferred from the imaging member to an intermediate transfer member for monitoring thereon by apparatus of the invention. In another embodiment, the toner particles in a test area are transferred from the imaging member to a receiver member prior to monitoring on the receiver member.

The invention can be used to detect and measure low coverages of any type of toner, such as for example but not limited to toners of so-called single component developers which do not contain carrier particles, as well as magnetized or magnetizable toners, color toners including cyan, magentas, yellow and black toners, clear or non-colored toners, and surface-treated toners having micro particles adhered to their surfaces. Toner coverages accurately measurable by the invention are usually too small to be detected with any accuracy by conventional densitometers.

A test patch area located on a photoconductor is charged, image-wise exposed and developed with toner particles so as to produce a test patch toner image having a same color as the color of the toner image developed in a corresponding image frame on the photoconductor. Photoexposure conditions for at least one portion of such a patch area are nominally characteristic of, or similar to, photo exposures delivered by the exposure device to background areas included in the corresponding photo exposed image frame. Similarly, development set points are typically substantially the same for both a test patch and a corresponding image frame, with the development station preferably utilizing a two-component developer but not limited thereto. As a result of similar conditions for exposure and development in a test patch area, certain portions of the test patch area preferably act as surrogates for corresponding areas in an image frame, and in particular, act as surrogates for background areas of an image frame.

It is well-known that unwanted toner particles can be deposited in background areas, e.g., as a result of developer aging, or as a result of a reduced photodischarge efficiency of a photoconductor due to fatigue of the photoconductor. Such background particles can be transferred to a receiver member, thereby producing objectionable toner lay downs in corresponding background areas in a print. A background area within an image frame is an area wherein under ideal conditions substantially no toner particles are laid down in the step of development of an electrostatic image on the surface of an imaging member. It is preferable in the practice of the subject invention that certain portions of a test area image have exposure and development conditions such that the coverages of toner laid down in these certain portions after passage through a development station are similar to toner coverages laid down in background areas of toner images in image frames. A signal such as can be obtained by monitoring a test area toner image with a read head can be used as a process control signal so as to change operating set points, e.g., of the toning station itself, or to alter the set points of some other process station in the electrostatographic machine, e.g., the set points for photodischarge of a photoconductor. Moreover, this signal can be monitored so as to provide an early warning of deterioration of a developer.

Alternatively, the invention may be used to measure a test patch toner image (e.g., a pattern of equally spaced bars) after transfer of the test patch toner image to a portion of a receiver member. Normally such a test patch image is not transferred to the receiver member, and such a transfer of a test patch toner image would in practice be initiated by a specially timed signal to the transfer station. The invention may additionally be used to measure, in an image frame on a receiver member, an optical density of toner particles in nominally untoned background areas of a toner image deposited thereon by a transfer station, such as for example an area located close to the margins or between the lines of a text image, such as for example in an image of a letter. In addition, an entire image frame on a toner-image-bearing member may from time to time be dedicated to detection and measurement of background toner, such that the image frame include one or more test patch bar images and/or one or more reference patch bar images.

The invention is especially useful to detect deterioration of the ability of toner particles to be suitably charged in a developer sump of a development station, the developer being inclusive of toner particles and carrier particles, with the toner particles being triboelectrically charged in well-known fashion via mixing contact with the carrier particles. In contrast to corresponding prior art devices that for example sense toner concentration changes in the developer, or measure the developability of an electrostatic image by toner, the subject invention measures very low toning levels in order to detect any loss of charging efficiency of fresh toner particles added to the developer sump, i.e., fresh toner particles replacing toner particles taken out from the sump during development of electrostatic images so as to form toner images on an imaging member. Of particular utility is the ability of the invention to provide early warning of developer deterioration relating to such loss of charging efficiency.

Figure 2:
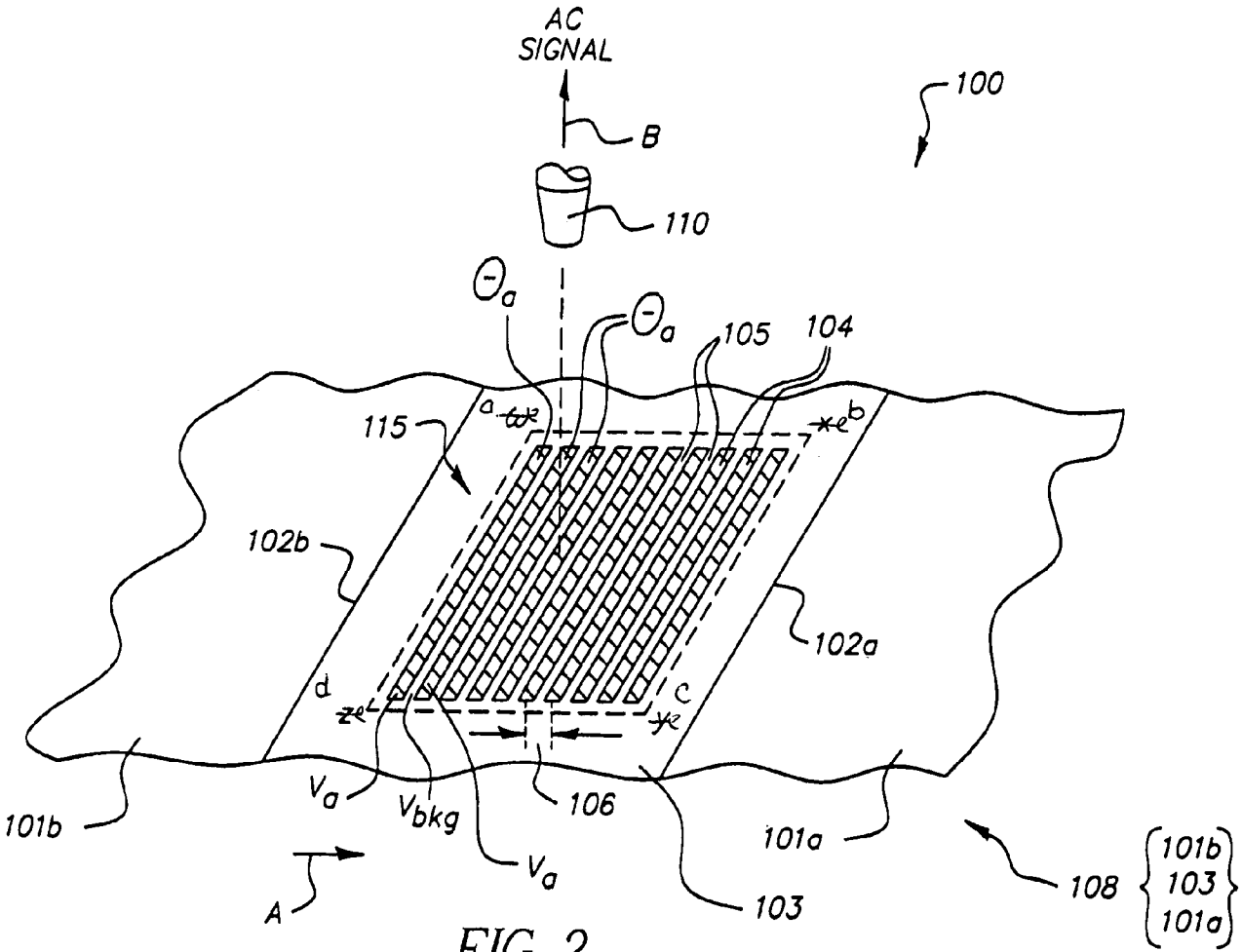
FIG. 2 illustrates a preferred embodiment for detection of a low coverage of toner representative of background toner particles in an image frame, the low coverage of toner in the form of spaced strips included in a control toner image located in a non-image area on a toner-image-bearing member.

Turning now to figures illustrative of the invention, FIG. 2 shows one embodiment designated by the numeral 100, in which, a control toner image 115 in the form of a patch image is detected by a detector 110 as the control toner image 115 is moved past the detector. 110 The control toner image 115 is a toned image situated in a non-image area 103 on the surface of a toner-image-bearing member 108, with member 108 moving at a constant speed in a process direction shown by arrow A. Toner-image-bearing member 108, of which a portion is shown, includes an image frame 101*a* having a boundary 102*a* with non-image area 103 and an image frame 101*b* having a boundary 102*b* with non-image area 103. An image frame on a toner-image-bearing member typically includes an unfused toner image, e.g., a toner image formed on an imaging member for transfer to a receiver member (toner images not shown). Non-image area 103, which is inclusive of control toner image 115, is preferably an interframe area, as illustrated in FIG. 2. However, a control toner image on a toner-image-bearing member, e.g., control toner image 115, may be situated on the surface of a toner-image-bearing member at any suitable place, which is not included in an image frame. A control toner image generally includes sub-areas wherein a low coverage of toner is a surrogate for a background toner coverage in a toner image on a toner-image-bearing member. The control toner image 115, is shown enclosed by parallelogram, abcd, which defines a control patch area. Control toner image 115 includes a set of spaced parallel strips 104, which strips 104 are preferably perpendicular to a process direction A. The strips 104, all of equal width, alternate with spaces 105. Preferably, strips 104 have a same width as spaces 105. Alternatively, the widths of strips 104 and spaces 105 may differ.

Typically, a control toner image is originated in a control patch area on an imaging member via toning of a control patch latent image, the control patch latent image on the imaging member being toned by toner particles having a nature similar to the toner particles relating to a background area included in a toner image located in an image frame. The control patch area on the imaging member is also located in an interframe area on the toner-image-bearing member.

Returning to embodiment 100, strips 104 may, depending on developer age, include toner particles representative of toner particles in a background portion of a toner image in an image frame 101*a,b*. The spaces 105 are substantially free of toner particles. It is preferred that strips 104 and spaces 105 all have a width of approximately 0.5 mm, such that the width of a distance 106 between each pair of like strips 104 is about 1 mm. However, any suitable widths for strips 104 and spaces 105 may be employed.

Figure 1B:
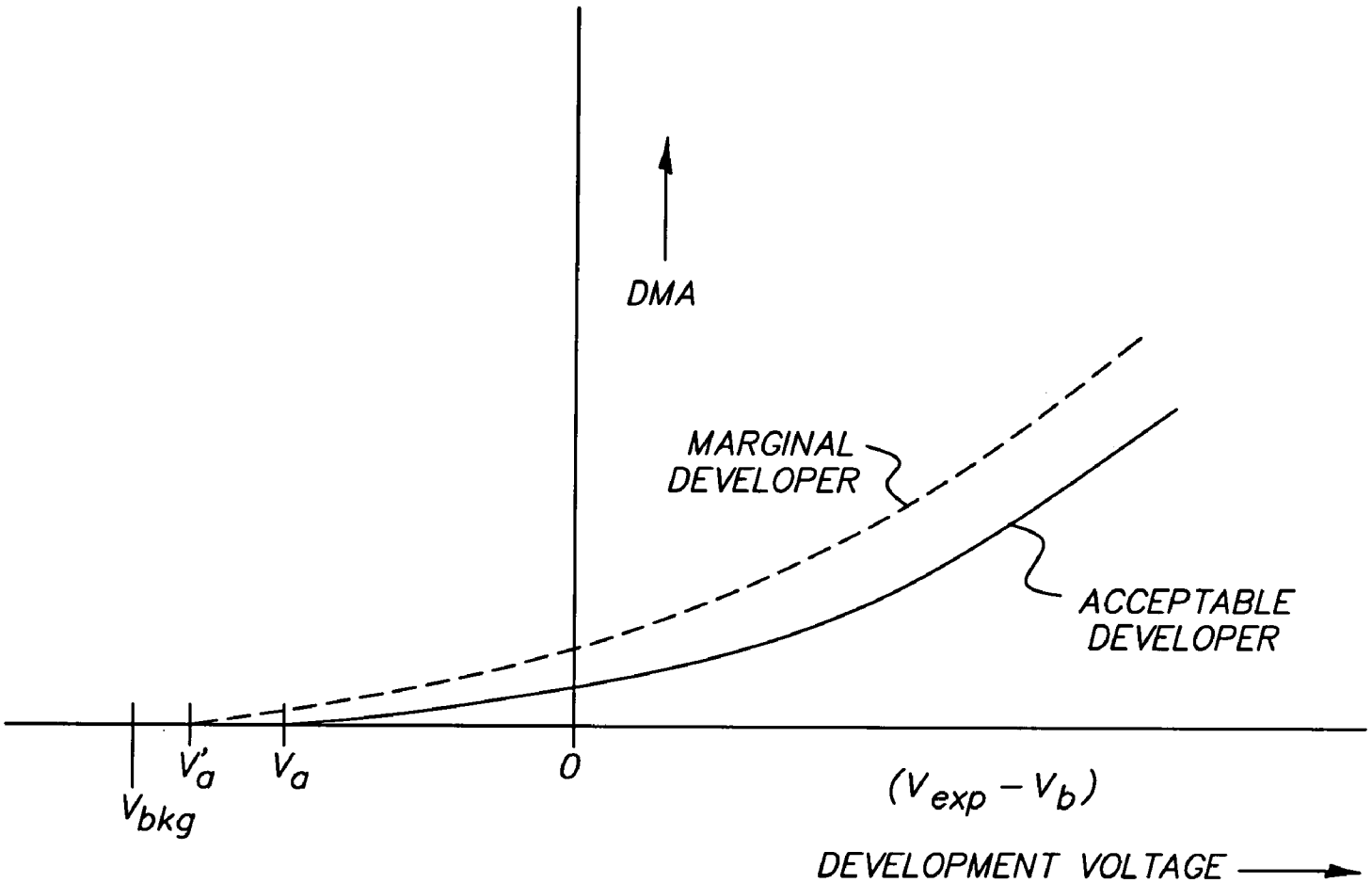
FIG. 1B is an exemplary graphical illustration relating to FIG. 1A, which compares threshold regions of toner mass lay down curves for a satisfactory developer and for an aged developer.

Referring again to the exemplary FIGS. 1A, 1B (as well as FIG. 2), spaces 105 are substantially free of toner (e.g., originated on a photoconductor by a photoexposure producing a development voltage preferably of magnitude less than or equal to the background development voltage, for example Vbkg). The strips 104 have a toner coverage θa, with θa originating in relation to a threshold development voltage, e.g., the threshold development voltage Va in FIG. 1A. As explained previously, when toner-image-bearing member 108 is for example a non-fatigued photoconductor, θa will be substantially zero when using a fresh developer having properly charged toner particles, and the entire control toner image 115 will be substantially free of toner particles. (In practice, the threshold potential Vth corresponding to Va can be empirically determined and readjusted as a photoconductor becomes fatigued). On the other hand, as fresh developer ages, θa will become non-zero, indicative of background toner deposition in background areas included in the image frames 101*a,b*. As toner-image-bearing member 108 moves past the detector 110, the toned strips or bars 104 are detected. Detector 110 is a small aperture optical detector preferably having an electronic output proportional to the quantity of light detected. Detector 110 has a sufficient resolution to detect each passing bar individually. Detector 110 detects light reflected from bars 104, the reflected light originating from an illuminator, e.g., one or more light sources directed towards the surface of member 108 (one or more light sources not illustrated). Thus an AC electric signal is produced by detector 110, which signal is sent to a signal processing circuit or a computer, as indicated by the arrow, B, in FIG. 2.

In embodiment 100 this AC signal can be readily filtered and amplified as necessary, i.e., embodiment 100 has all the well-known advantages associated with AC detection. In an alternative embodiment, non-image area 103 is transparent so that detector 110 can detect a transmitted light signal. These embodiments are advantageous in being able to detect low coverages of toner particles, θa, which low coverages are not measurable by conventional reflection or transmission densitometers.

In reference to embodiment 100 (and in reference also to the other embodiments of the subject invention disclosed below) a difference between incident light reflected from (or transmitted through) parallel toned bars such as strips 104 and light reflected from (or transmitted through) toner-free strips such as spaces 105, even though not measurable by conventional densitometry because of noise, must nevertheless exist so as to obtain a useful AC signal using a detector (e.g., detector 110). This is possible using techniques well-known in the art, such as used in the configuration of the Hubble patent, U.S. Pat. No. 4,553,033, with a preferred requirement that the detector be focused approximately on the width of a line, or narrower. In addition, it is preferable that the detector has, for example, a short slit parallel to the bars for admitting the reflected (or transmitted) light, or has an elliptical field with a high aspect ratio rather than a circle so as to collect light from a larger area, with the slit width or the short axis of the ellipse preferably not exceeding the width of a strip.

In certain applications, the sensitivity of the detector is enhanced by matching the spectral contents of the reflected (or transmitted) light with the wavelength(s) of maximum spectral sensitivity of the detector, so as to maximize contrast. In an illustrative example of this technique, magenta toner strips are to be detected in reflection mode on a green surface using either "positive contrast" or "negative contrast" detection. In detection utilizing "positive contrast", a green filter would be used in the illuminator or in the detector, or in both, which advantageously increases sensitivity by making the magenta toner appear "darker". In the alternative case of "negative contrast", a magenta filter would be used such that the magenta toner reflects more light per unit area than the substrate, thereby enhancing the sensitivity of detection. For either "positive contrast" or "negative contrast" detection, a faint AC signal is typically obtained, and a calibration with respect to a processed output signal from the detector allows the development of a predictive control algorithm, i.e., for generating a control signal as described above.

In a preferred geometry, illumination is provided by a substantially non-divergent light beam at 45 degrees incidence, with the detector at 45 degrees reflection angle so as to detect the specularly reflected light from the control patch image. Alternatively, the detector can be aligned 90 degrees from the surface plane so as to collect diffusely reflected light. With the detector at 90 degrees, diffuse illumination emanating from one or more directions can alternatively be used. In certain applications, the toner-image-bearing member is a photoconductor in the form of one or more thin films coated on a reflective substrate, such as for example a polished aluminum substrate.

In reference to the illustrative example above in which a magenta toner lies on a green surface coated on a shiny substrate, specular reflection is due primarily to the shiny substrate, with the photoconductor film(s) acting as a green filter. Thus when using green incident light in the 45 degree/45 degree geometry described above, the magenta toner will reduce the amount of reflected light in comparison with the untoned strips, but with magenta incident light the toner will be the dominant source of reflected light entering the detector.

Figure 3A:
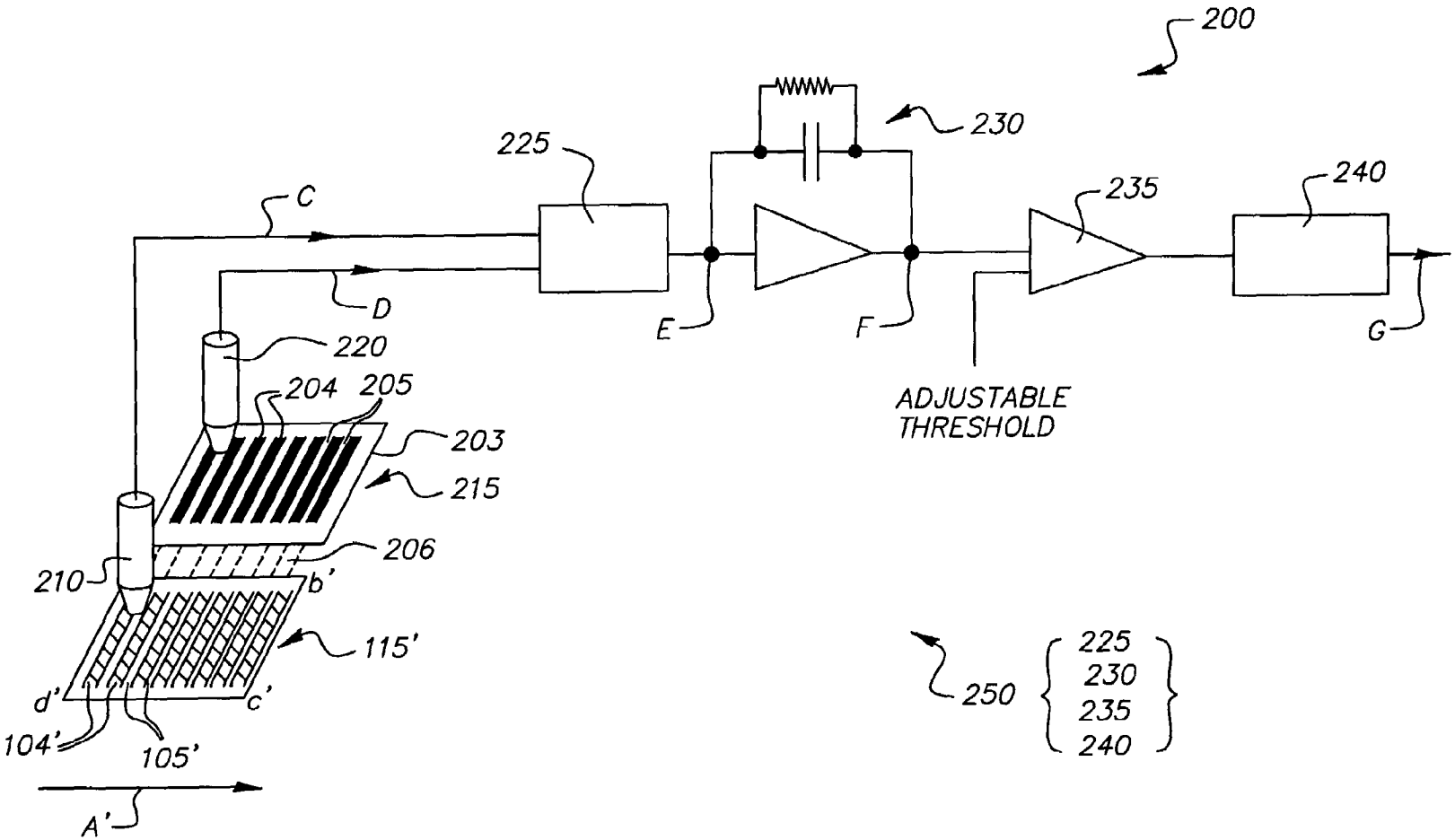
FIG. 3A illustrates another preferred embodiment for detection of a low coverage of toner representative of background toner particles in an image frame, the low coverage of toner in the form of spaced strips included in a control toner image located in a non-image area on a toner-image-bearing member, with synchronous detection of the control toner image and a reference toner image patch also located in the non-image area on the toner-image-bearing member.

An improved sensitivity over embodiment 100 is provided by a preferred embodiment 200 illustrated schematically in FIG. 3A. Embodiment 200 utilizes the well-known technique of synchronous detection. In FIG. 3A, a prime (') indicates that an element is entirely similar to a corresponding element of FIG. 2. A control toner image 115' is on the surface of a toner-image-bearing member, where the points b', c', and d' are equivalent to points b, c, and d, and the strips or bars 104' and spaces 105' are respectively equivalent to strips 104 and 105. The toner-image-bearing member itself is not shown in FIG. 3A, it being understood that control toner image 115' is positioned in an interframe area situated between successive image frames, as in embodiment 100. Located beside control toner image 115' is a reference toner image 215, which reference toner image 215 is included in parallelogram 203 which defines a reference patch area. Reference toner image 215 has alternating strips 204 and spaces 205 which are preferably perpendicular to the process direction shown by arrow A', in which process direction A' the control toner image 115' and the reference toner image 215 are moved at a constant speed. The strips 204 preferably have similar dimensions and spacings as strips 104', and spaces 205 preferably have similar dimensions and spacings as spaces 105'. An important feature is that the pattern of alternating strips 204, spaces 205, in the reference toner image is in phase with the pattern of alternating strips 104', spaces 105', in the control toner image 115', as indicated by the dotted lines 206.

In reference toner image 215, the spaces 205 are substantially toner-free and are formed on the toner-image-bearing member in similar fashion to the formation of spaces 105'. The strips 204 have a toner coverage higher than strips 104', and it is preferred for strips 204 to have a high toner coverage, and more preferably, to have a maximum developed mass per unit area equal to $DMA_{max}$ (see exemplary FIG. 1A). Thus when the toner-image-bearing member is for example a photoconductor, $DMA_{max}$ corresponds to a development voltage equal to $(V_0-V_b)$ for the CAD process illustrated in FIG. 1A.

The control toner image 115' and the reference patch image 215 are detected optically via reflected (transmitted) light, in fashion entirely similar to that of embodiment 100. Thus a control optical detector 210 is provided for detecting preferably reflected light from the control toner image 215 moving past detector 210, and a reference optical detector 220 is provided for detecting preferably reflected light from the reference toner image 115' moving past detector 220. Preferably detectors 210 and 220 are small aperture detectors similar in all respects to detector 110 of embodiment 100. Thus, an AC control signal is generated by the control detector 210, and an AC reference signal in phase with the AC control signal is generated by the reference detector 220. Using a well-known analog signal processing approach, the AC control signal and the AC reference control signal are sent via respective connections labeled C and D to a synchronous detection circuit, indicated by the numeral 250.

The synchronous detection circuit 250 sequentially includes a signal multiplier device 225, a low pass filter 230, a comparator 235, and a sample and hold device 240. Signal multiplier device 225, low-pass filter 230, comparator 235, and sample and hold device 240 are devices of types well known in the art.

The signal multiplier device 225 multiplies together the AC reference signal and the AC control signal. Assuming for sake of example that the AC reference signal is Cos(ωt), i.e., having a magnitude normalized to one, and the AC control signal (neglecting any noise signal) from the low coverage of toner in the strips 104' is Z Cos(ωt), i.e., having a much smaller magnitude, Z. At the circuit position labeled E, the output signal from the signal multiplier device is proportional to Z $Cos^2(\omega t)$, which is mathematically identical to 0.5Z(1+Cos(2ωt)) where ω is 2π times cycles/sec. After passing through the low pass filter 230, the AC component is removed, so that the output signal from the low pass filter at the circuit position labeled F is a DC signal having magnitude proportional to 0.5Z, which is proportional to the low coverage of toner in the strips 104'. The DC component is then sent to comparator 235, which comparator 235 has an adjustable threshold, and from thence to the sample and hold device 240. An output signal from the sample and hold device 240 is preferably a control signal as indicated by the arrow G, which control signal can indicate "background toner detected" or "no background toner detected". More generally, the control signal can indicate whether the low coverage of toner particles representative of background toner in an image frame is in excess of a threshold coverage or a pre-selected coverage, or can measure a percentage of the threshold coverage or pre-selected coverage. The control signal can be a process control signal, which process control signal can for example be used to adjust the parameters of a toning process, or of a photoexposure process.

Figure 3B:
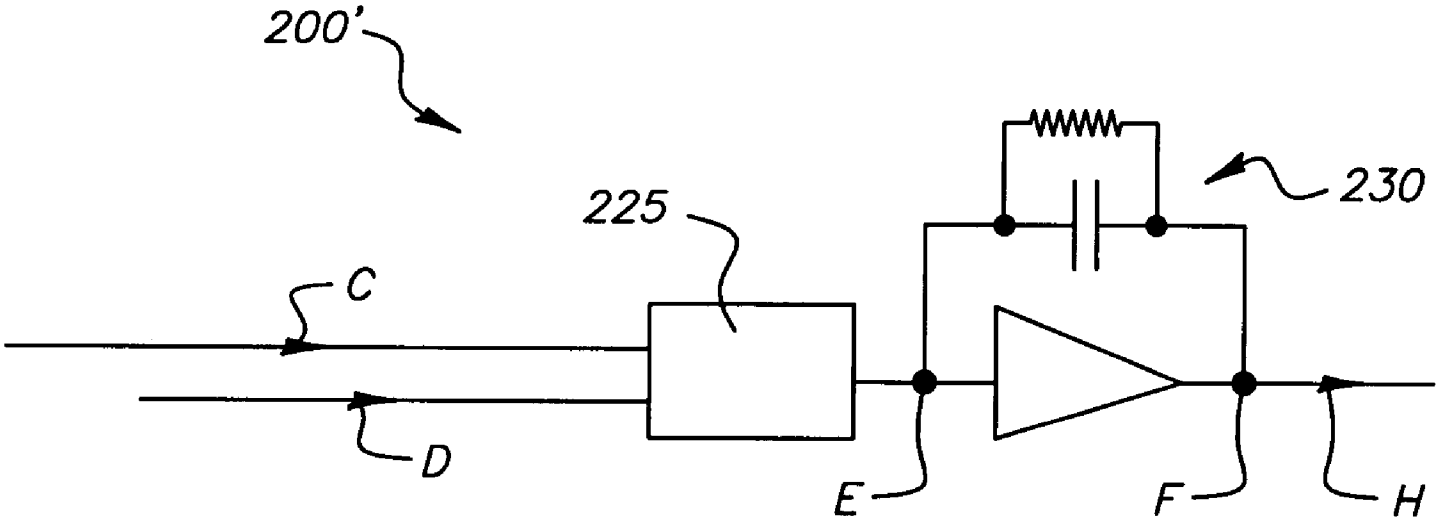
FIG. 3B illustrates an alternate embodiment of the detection circuit derived from the embodiment of FIG. 3A.

An alternative embodiment 200', shown partially illustrated in FIG. 3B, includes all of the material elements of embodiment 200 excepting the comparator 235 and the sample and hold device 240. In FIG. 3B, only the signal multiplier device 225 and low pass filter 230 of embodiment 200 are shown. In the alternative embodiment 200', the signal at point F is outputted in the direction of arrow H for use in any suitable way, e.g., sent to a computer and/or used as a control signal.

In another preferred embodiment (not illustrated) synchronous detection is used in a manner analogous to the manner of embodiment 200, except that the reference AC signal is not obtained from a parallel patch but is derived from other sources permitting good synchronization with the strips in the control patch area. These other sources, which are preferably of non-electrostatographic origin, include encoder signals accurately monitoring the position of the toner-image-bearing member, perforations located along an edge of a toner-image-bearing member in the form of a web or belt, or image registration marks located on the toner-image-bearing member. Thus when the control AC signal has a certain frequency, the reference AC signal preferably has a calibrated amplitude and a reference frequency suitable for use with the control AC signal in a synchronous detection circuit, so that the synchronous detection circuit produces a DC output having an amplitude proportional to the low coverage of toner particles in the control-toned image. An advantage of this embodiment is that only a single detector need be used, i.e., to monitor the control toner image. As a result of this advantage, the reference signal may be included in a reference patch area which is inclusive of a set of preferably high-density equally spaced bars, the bars in the reference patch area being parallel with, preferably adjacent to, and in phase with the low coverage strips of the control toner image, where the reference patch area can be monitored by a single detector, i.e. with the set of bars of the reference image being lined up with the control toner image in a direction parallel with the direction of motion of the toner-image-bearing member.

Figure 4:
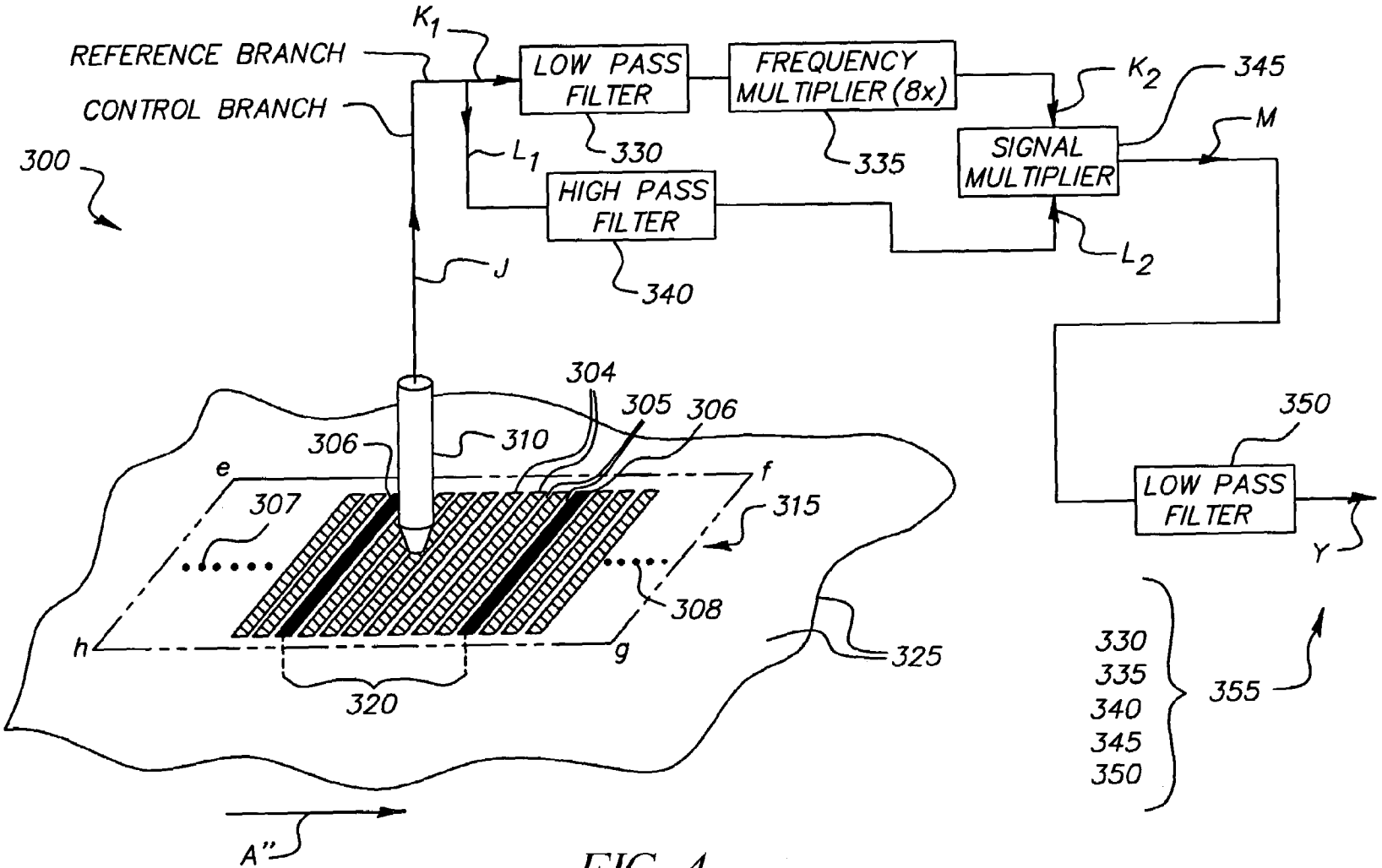
FIG. 4 illustrates yet another preferred embodiment of the invention, showing a composite toner patch image on a toner-image-bearing member being moved past a detector for detecting a low coverage of toner representative of background toner particles in an image frame, the low coverage of toner being in the form of spaced strips and the composite toner patch image including spaced reference strips having a high coverage, the detector sending a signal to a circuit for synchronously detecting in the composite toner patch image the low coverage of toner.

In a preferred embodiment 300 illustrated in FIG. 4, a low coverage of toner particles relating to a background area of a toner image in an image frame is included in a composite toner patch image 315 located on a toner-image-bearing member 325 (member 325 partially indicated, image frame not indicated in FIG. 4). Preferably, the toner-image-bearing member 325 is a photoconductive imaging member. The composite toner patch image 315, defined by the parallelogram, efgh, is located in a non-image area which is preferably an interframe area, the composite toner patch image 315 including a plurality of equally spaced toned strips inclusive of strips 304 and 306. Strips 304 and 306 are mutually parallel and perpendicular to the direction of movement of toner-image-bearing member 325, as indicated by the arrow, A".

The toned strips include control toned strips 304 and reference-toned strips 306, the control toned strips 304 having a lower coverage of toner than the reference-toned strips 306, with this lower coverage substantially equal to a low coverage of toner particles in a background area of a toner image in an image frame. Preferably, the reference-toned strips 306 have the maximum developed mass per unit area. The developed mass per unit area of the control-toned strips 304 is a fraction, Z, of the developed mass per unit area of the reference-toned strips 306. The control toned strips 304 and the reference-toned strips 306 form a periodically repeating arrangement of strips repeating adjacently along direction A".

As illustrated in FIG. 4, a repeating arrangement of strips 320 is shown having seven control toned strips 304 for each reference toned strip 306. However, a preferred embodiment 300 generally includes in composite toner patch image 315, a periodically repeating arrangement of strips which has an integral number of control toned strips successively following the reference toned strip, with this integral number preferably greater than or equal to 3, such that there is a lower frequency component from the reference-toned strips and a higher frequency component from the control toned strips. In the particular periodically repeating arrangement of strips 320, this integral number is 7, with the control toned strips 304 having a frequency 8 times greater than the reference-toned strips 306.

In embodiment 300, a periodically repeating arrangement of strips such as arrangement 320 is repeated a number of times parallel to direction A", as indicated by the dotted lines 307, 308. A suitable mechanism (not illustrated) is provided to give a very uniform speed of composite toner patch image 315 past an optical detector 310 for detecting the periodically repeating arrangement of strips as an output signal, J. Optical detector 310 is entirely similar to detector 220 of embodiment 200, the spacing between the equally spaced strips in arrangement 320 being entirely similar to the spacing 206 in FIG. 3A. The output signal, J, is a composite AC signal inclusive of the lower frequency component from the reference-toned strips 306 and the higher frequency component from the control toned strips 304.

The signal J is delivered into a synchronous detection circuit 355 which includes a control branch, labeled $L_1$, and a reference branch, labeled $K_1$. The reference branch $K_1$ removes the higher frequency component from the composite AC signal in a low pass filter 330 so as to leave the lower frequency component or reference component. Since the speed of the strip-bearing member is kept substantially constant, and the writer of the strips is usually well synchronized with such speed, the frequency of the detected signal is constant within narrow limits permitting the use of notch filters. Accordingly, the low pass filter 330, for example, can be a notch filter permitting only the lower reference frequency to pass. The reference component is then passed through a frequency-multiplying device 335 so as to produce a reference branch signal $K_2$ having a frequency substantially the same as the higher frequency component. For the particular repeating arrangement of strips 320, the frequency-multiplying device 335 multiplies the frequency of the lower frequency component by 8. The portion of the composite AC signal entering the control branch labeled $L_1$ is passed through a high pass filter 340 so as to produce a control branch signal $L_2$ from which the strong reference frequency was eliminated, thus carrying only the noise-obscured higher frequency component. The control branch signal $L_2$ and the reference branch signal $K_2$ are multiplied together in a signal-multiplying device 345 and the resulting signal M is passed through a low pass filter 350 so as to produce an output signal, Y, having a DC component of a magnitude proportional to the low coverage of toner particles in strips 304.

Thus in the reference branch $K_1$, the reference component leaving low pass filter 330 can be written as Cos(ωt), i.e., the reference component has an assigned normalized amplitude equal to one. This normalized amplitude can be experimentally calibrated in terms of the readily measurable developed mass per unit area of the high coverage of toner in the reference strips 306. In reference to the particular repeating arrangement of strips 320, after passage through the frequency multiplier 335 the emergent reference branch signal is Cos(8ωt). In the control branch $L_1$, the control branch signal $L_2$ emerging from the low pass filter 340 is given by [Z Cos(8ωt)+N(t)], where N(t) is a random noise signal contained in the control branch signal $L_2$. The signal M emerging from the signal multiplier 345 is given by:

$$M=Z\,\mathrm{Cos}^2(8\omega t)+\mathrm{Cos}(8\omega t)N(t)=0.5Z(1+\mathrm{Cos}(16\omega t))+N(t)\mathrm{Cos}(16\omega t).$$

Passage of signal M through low pass filter 350 results in a DC output signal, Y, with Y=0.5Z. Thus, the output signal Y has a magnitude that is proportional to the toner coverage of the control strips 304, which low coverage can be extracted quantitatively via the experimentally known calibration for the toner coverage in the reference strips 306.

Figure 5A:
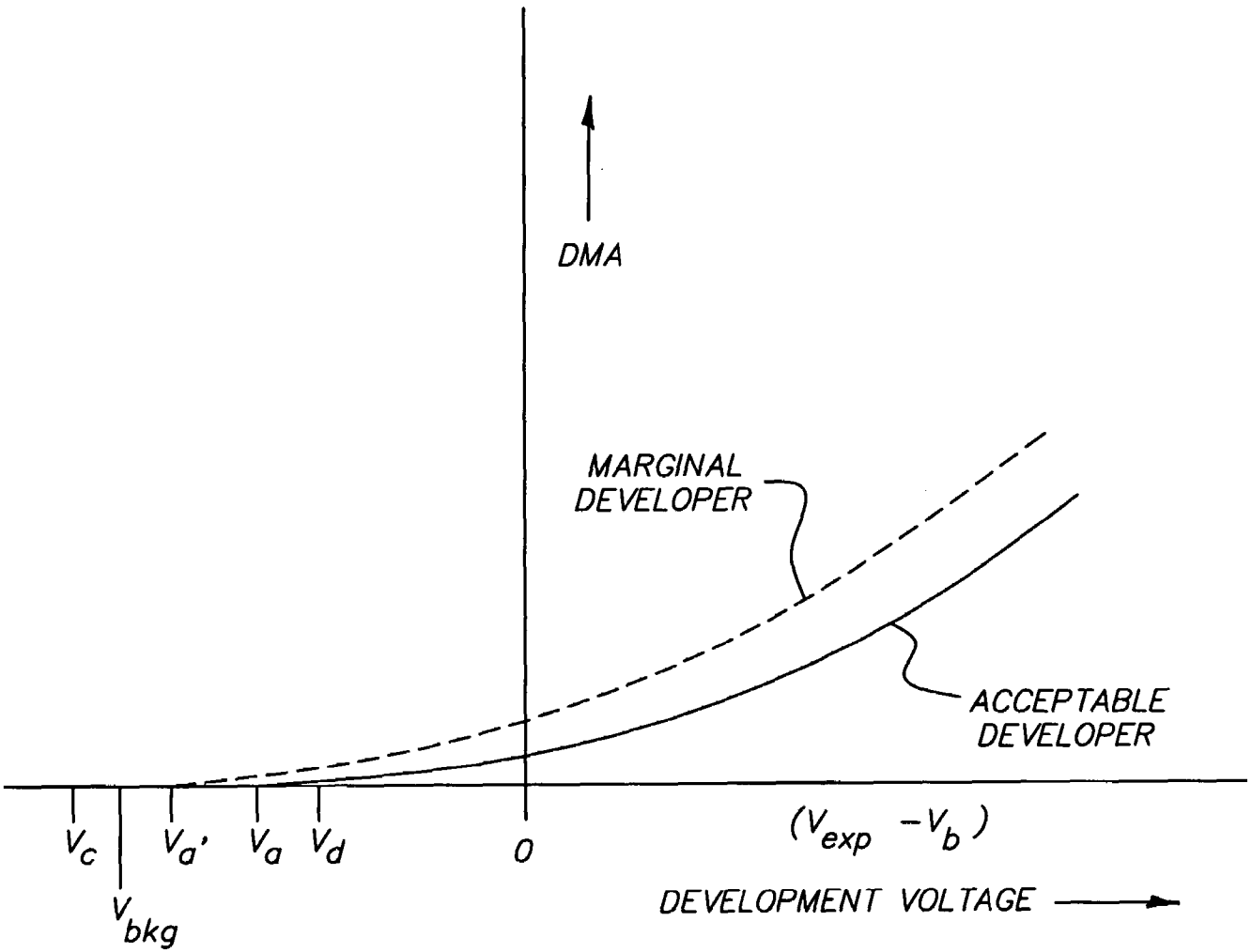
FIG. 5A illustrates, in reference to similar exemplary FIG. 1B, certain development voltages for producing the control patch latent image illustrated in FIG. 5B.
Figure 5B:
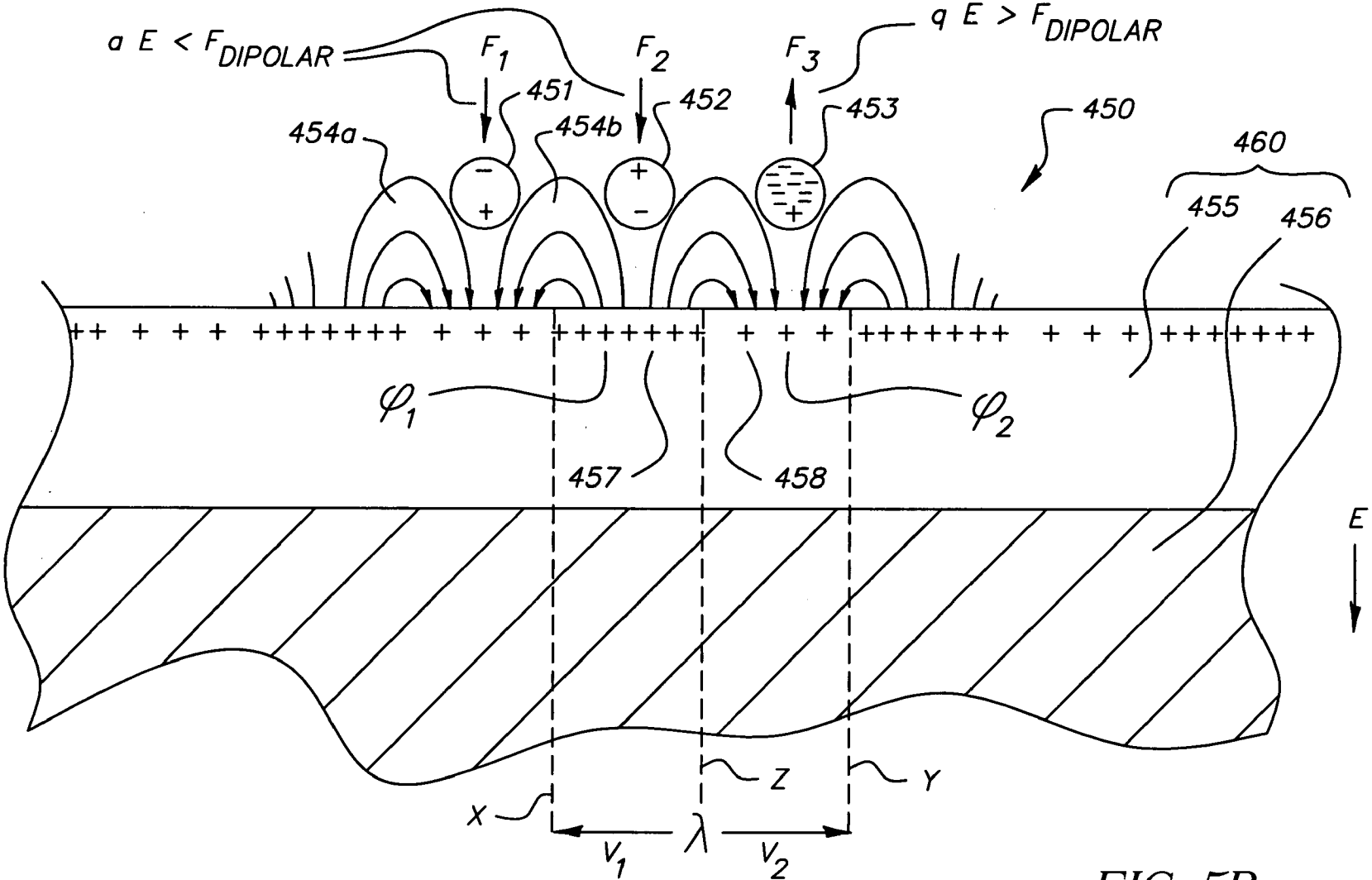
FIG. 5B diagrammatically shows electric fields associated with dielectrophoretic development of a control patch latent image on an imaging member.
Figure 5C:
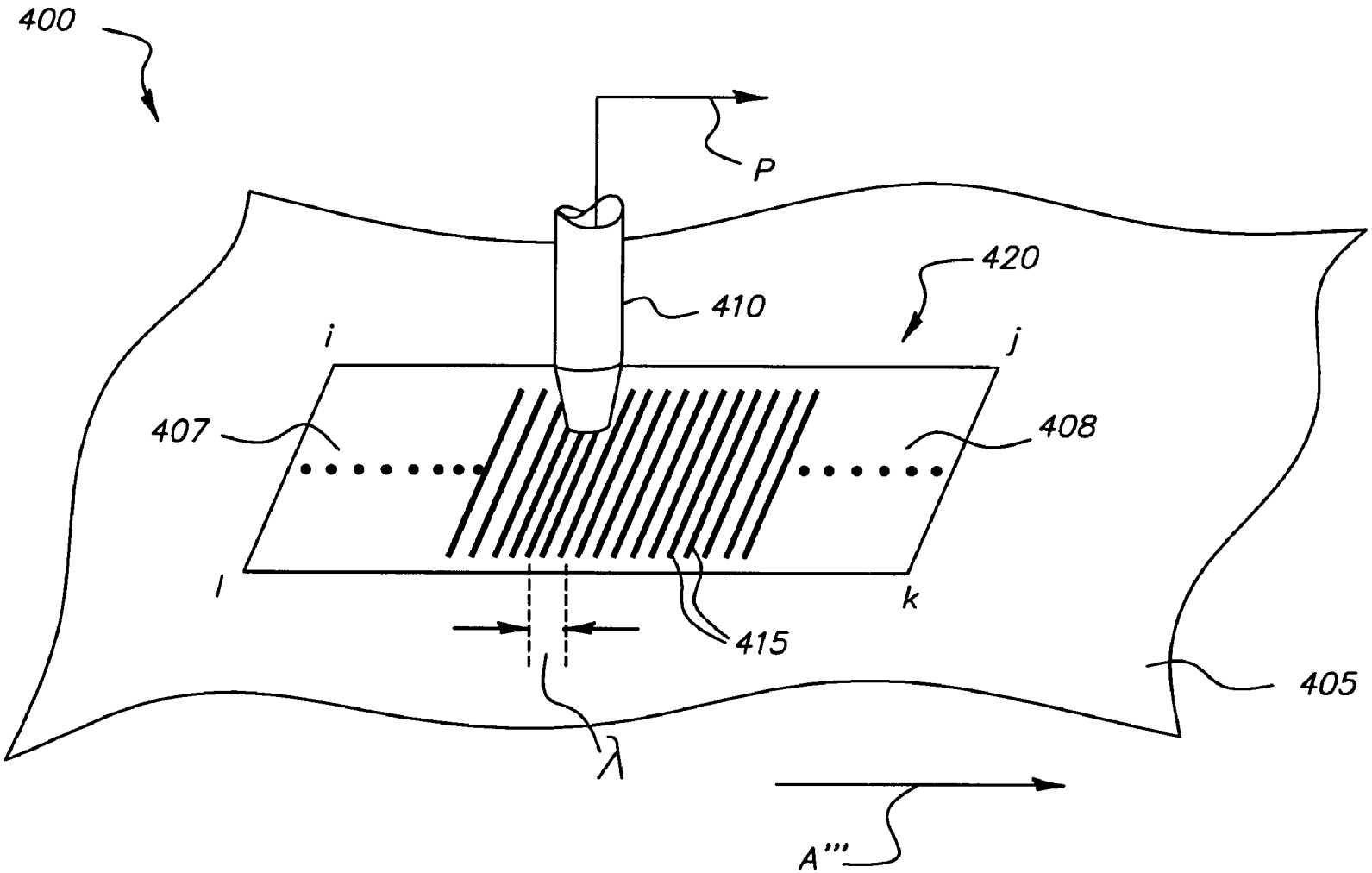
FIG. 5C illustrates still yet another preferred embodiment of the invention, in which a control toner image on a toner-image-bearing member is moved past a detector for detecting a low coverage of toner representative of background toner particles in an image frame, the low coverage of toner being in the form of relatively high frequency spaced strips formed as a result of dielectrophoretic development, in a toning station, of a control patch latent image similar to that of FIG. 5B.

In another preferred embodiment 400, illustrated in FIG. 5C, a control toner image 420 is inclusive of toned lines 415 formed by development of a control patch latent image. A suitable control patch latent image is identified by the numeral 450 in FIG. 5B. Development voltages for producing the toned lines 415 are defined below with reference to FIG. 5A.

With reference now to exemplary FIG. 1B, FIG. 5A illustrates certain development voltages for producing the control patch latent image 450 in FIG. 5B. FIG. 5A, which includes the information of exemplary FIG. 1B, additionally indicates two other development potentials, Vc and Vd, described below. Following the discussion relating to FIG. 1B and for purpose of illustration, the control patch latent image can be considered as formed via photoexposure of a positively charged photoconductor, with the development station using a nominally negatively charged toner (CAD process). However, a control toner image 420 for use in embodiment 400 may alternatively be formed via photoexposure of a negatively charged photoconductor. Also, the nominal polarity of the toner particles can be positive or negative. Therefore development of a control patch latent image having a particular polarity can be via either a CAD or a DAD process. Thus for development potentials ($V_{exp}-V_b$) which are positive, as in representative control patch latent image 450, the electric field for development is in a direction so as to urge negatively charged toner particles towards the photoconductor surface, whilst for negative development potentials the electric field for development is in the opposite direction so as to repel the toner. As previously described in reference to exemplary FIG. 1B, the curves labeled "acceptable developer" and "marginal developer" in FIG. 5A have negative threshold development potentials, Va and Va', respectively.

FIG. 5B shows a portion of a cross-section of an imaging member or photoconductor 460 bearing the representative control patch latent image 450, the charged photoconductor 460 inclusive of a photoconductive layer (or layered structure) 455 and a substrate 456 upon which layer(s) 455 is coated. The representative control patch latent image 450 includes equi-spaced positively charged surface strips, with the long directions of the strips perpendicular to the plane of the cross-sectional view of FIG. 5B. The equi-spaced strips include one set of strips having an average surface potential, $V_1$, and another set of strips having an average surface potential, $V_2$, with the two sets of strips alternating with one another as shown. The strips having average surface potential $V_1$ are defined by the dashed lines labeled "x" and "z" and include positive charges 457 having an average charge density, $\sigma_1$. The strips having average surface potential $V_2$ are defined by the dashed lines labeled "z" and "y" and include positive charges 458 having an average charge density, $\sigma_2$, with $\sigma_2<\sigma_1$ and $V_2<V_1$. The positive potentials $V_1$ and $V_2$ are defined as:

$$V_1=(Vc+V_b)\text{ and }V_2=(Vd+V_b),$$

where Vc and Vd can be respectively identified in FIG. 5A as development voltages ($V_1-V_b$) and ($V_2-V_b$). Electric field lines 454*a* and 454*b*, exterior to the latent image 450, are sketched and show a symmetric field distribution having a width, λ, where λ is twice the width of an individual strip. Inasmuch as Vc and Vd are negative, a negatively charged toner particle will be repelled from both sets of strips. However, when toner particles are located within the external electric field distribution associated with latent image 450, they are generally polarized.

When latent image 450 is in the toning station, a toner particle 453 bearing a nominal negative charge and having a relatively weak polarization, is repelled by a net force $F_3$. Repulsion generally occurs when qE>Fdipolar, where q is the toner particle charge (here negative), E is the development electric field, and Fdipolar is the dielectrophoretic force associated with the non-uniform electric fields close to the surface of photoconductor 460. On the other hand, when the toner particle has a very low (negative) charge in the development station, or is uncharged as indicated for particles 451 and 452, polarization of such particles is the dominant effect and the dielectrophoretic force causes such particles to be attracted to the surface of photoconductor 460, with forces $F_1$ and $F_2$ as shown, i.e., when qE<Fdipolar. It will be evident that any wrong-sign (positively charged) toner particles will be attracted to the representative control patch latent image 450, with both qE and Fdipolar directing wrong-sign particles towards the surface of photoconductor 460.

In the embodiment of the invention, illustrated in FIG. 5C a control toner image on a toner-image-bearing member is moved past a detector for detecting a low coverage of toner representative of background toner particles in an image frame. In embodiment 400, a control toner image 420, defined by parallelogram, ijkl, is moved in a process direction A''' past an optical detector 410. The Control toner image 420, which is located on a toner-image-bearing member 405, originates via development of a control patch latent image on an imaging member, e.g., such as for example control patch latent image 450 of FIG. 5B, where the control patch latent image includes a plurality of mutually adjacent charged strips perpendicular to direction A''', and with each charged strip having a certain width measured parallel to direction A''' (control patch latent image not indicated in FIG. 5C). The plurality of mutually adjacent charged strips includes a first number of charged strips each of which has a first charge density, and a second number of charged strips each of which has a second charge density. The first and second charge densities are at levels to produce in the development station corresponding electric fields in a direction so as to inhibit toning by nominally charged toner particles. The first charge density and the second charge density have differing magnitudes.

The first number of charged strips and the second number of charged strips of the control patch latent image are mutually interleaved in alternating fashion, with associated (non-uniform) electric fields there between, which induce toning via dielectrophoretic forces, e.g., so as to form control toner image 420 in a development station. With reference again to FIG. 5B, the interleaved strips of charge in the control patch latent image 450 have a spacing equal to ($\lambda/2$). Thus a corresponding control toner image 420 has equi-spaced toned lines 415 having a frequency twice that of the corresponding control patch latent image 450. The toned lines 415 are extended as indicated by the dotted lines 407, 408 so as to fill the parallelogram, ijkl. The toned lines 415 preferably have a frequency in a range of approximately between 4 cycles/mm–10 cycles/mm. Such a frequency advantageously permits use of an inexpensive optical detector 410, e.g., a wide aperture conventional densitometer producing a DC output signal indicated by the arrow, P. This DC output signal can be compared, e.g., in a computer, to a threshold coverage or a pre-selected coverage of toner particles, where the DC output signal is calibrated experimentally with a known developed mass per unit area of toner. Embodiment 400 is also advantageous in amplifying a difference between no toning and low charge toning so as to make a reflectance change larger and thus easier to detect by an installed reflection densitometer.

Figure 6:
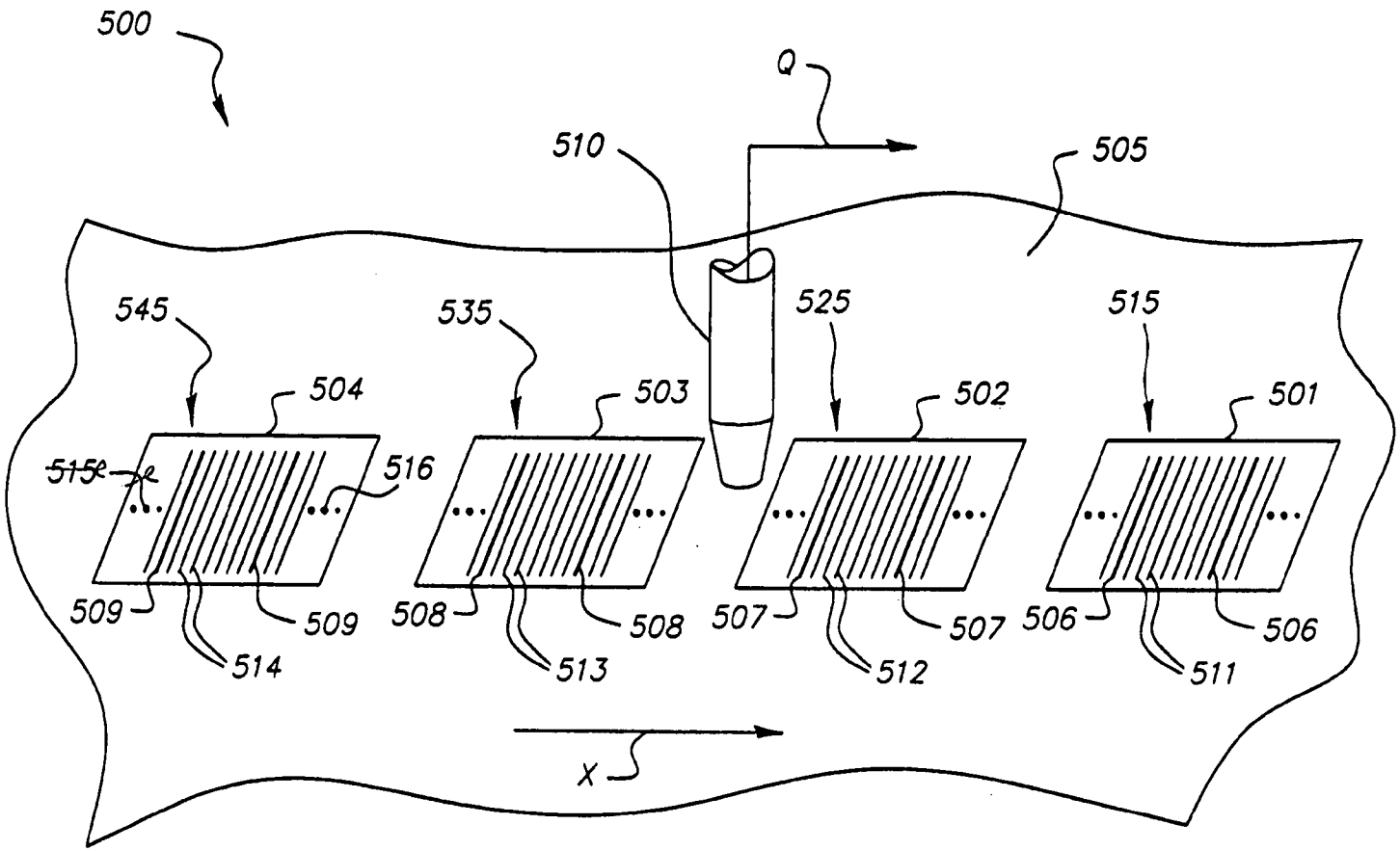
FIG. 6 illustrates an embodiment wherein composite color-toner images each of a different color are located linearly on a moving receiver member and detected by an optical detector for detecting a respective post-transfer low toner coverage in a respective composite color-toner image transferred to the receiver member in an image frame thereon, the respective composite color-toner image including reference toner strips and control toner strips, the reference toner strips having a relatively high post-transfer coverage of toner, and the control toner strips having a respective low post-transfer toner coverage, and a frequency that is an integral multiple of the frequency of the reference strips (illustrated integral multiple=8).

In another preferred embodiment 500, shown in FIG. 6, the toner-image-bearing member is a receiver member carrying a test image representative of background toner particles, the test image contained in an image frame area partially indicated as area 505. The test image includes a color sub-image having a respective color, the color sub-image included in a plurality of color sub-images such as the four color sub-images indicated in FIG. 6 by the numerals 515, 525, 535, and 545, the four color sub-images contained in respective parallelograms 501, 502, 503, and 504. The color sub-images 515, 525, 535, and 545 can for example be made of cyan, yellow, magenta and black toners, respectively.

A color sub-image generally includes a plurality of control strips having a respective post-transfer low coverage of toner particles of a respective color, e.g., control strips 514 of color sub-image 545, with the respective post-transfer low coverage of toner particles relating to a respective background area on a toned imaging member. For example, any of color sub-images 515, 525, 535, and 545 can originate in a background area in a toned image frame on a photoconductor prior to transfer to the receiver member. A color sub-image further includes a respective plurality of reference strips, e.g., reference strips 509 of color sub-image 545, the reference strips 509 of the same color as the control strips 514, with the reference strips 509 having a relatively high respective post-transfer reference coverage of toner particles. Thus the color sub-images 515, 525, 535, and 545 respectively include the reference strips 506, 507, 508, and 509 and the control strips 511, 512, 513, and 514.

The reference strips and the control strips are conveniently shown as lines in FIG. 6, and the intervening spaces (not identified by numbers) represent bare strips free of toner. Preferably, each of the interleaved bare strips, the reference strips and the control strips has a same width. The test image inclusive of the color sub-images 515, 525, 535, and 545 is moved at a steady rate past an optical detector 510 in a direction shown by the arrow, X, with the control strips 514 and the reference strips 509 being preferably perpendicular to the direction of movement of the receiver member. Each of the color sub-images shown in FIG. 6 is preferably geometrically similar to composite toner patch image 315 of embodiment 300 (FIG. 4), i.e., is a repeating arrangement as for example indicated by the dotted lines 516. The optical detector 510 is preferably entirely similar to detector 310 (FIG. 4). The color sub-images 515, 525, 535, and 545 are preferably lined up in succession along the direction X, and therefore are advantageously detected by the single detector 510. A suitable mechanism (not illustrated) is provided to give a very uniform speed of the color sub-images 515, 525, 535, and 545 past the detector 510. A receiver member bearing color sub-images 515, 525, 535, and 545 is preferably situated within an electrostatographic machine, or alternatively, the receiver member can be monitored at an external location, e.g., by detecting the color sub-images on an output color test print.

An AC signal, indicated by the arrow Q, is generated by detector 510, which AC signal preferably includes a plurality of control components having a control frequency. Each plurality of control components originates from detection of the control strips in a corresponding color sub-image. The amplitude of a control component is proportional to the respective post-transfer low coverage of toner particles in the respective control strips. The AC signal further includes a plurality of reference components having a reference frequency, which reference frequency is lower than the control frequency. Each plurality of reference components originates from detection of the reference strips in a corresponding color sub-image, with the amplitude of a control component being proportional to the respective post-transfer reference coverage of toner particles in the respective reference strips. A respective reference component and the corresponding control component are processed in a synchronous detection circuit, which synchronous detection circuit has an output proportional to the respective post-transfer low coverage of toner particles (synchronous detection circuit not shown in FIG. 6). Thus a sequential synchronous detection of the successive low coverages of toner in the successive sets of control strips is performed by the synchronous detection circuit, allowing each corresponding post-transfer low coverage of toner relating to a respective background coverage to be separately measured. Preferably, this is accomplished for the composite toner patch color sub-images 515, 525, 535, and 545 by utilizing a synchronous detection circuit closely derived from circuit 355 of embodiment 300 (FIG. 4).

Any of the above-described embodiments of the subject invention can be employed in an electrophotographic color printing machine which preferably includes a number of tandemly arranged electrophotographic image-forming modules (see for example, U.S. Pat. No. 6,184,911). In an exemplary machine of this type, a receiver member adhered to a transport web is moved past successive imaging modules, e.g., four modules, such that four color separation toner images are transferred to the receiver member one atop the other so as to create a full color unfused toner image on the receiver member. The receiver member, typically carrying cyan, magenta, yellow and black color separation toner images, is then moved to a fusing station where the full color toner image is fixed to the receiver member using heat and/or pressure.

Each module typically includes a photoconductive roller, an intermediate transfer roller, and a backup transfer roller such that the moving transport web (and receiver member) are sandwiched between the intermediate transfer member and the backup transfer roller. Around the periphery of the photoconductor roller is a charging device such a corona charger, an exposure station for creating latent images, a developer station for toning the latent images, and a cleaning station for regenerating a substantially toner-free surface to re-enter the charging station for another image. Each module can include apparatus relating to any of the embodiments according to the subject invention.

Thus for example in the first module, using embodiment 300 of FIG. 4, a composite toner patch image for the first color separation is located in an inter-image or interframe area on the surface of the photoconductor downstream from the development station, i.e., located between successive image frames on the rotating photoconductor. The composite toner patch image is preferably created in the interframe area by charging, exposing, and developing with toner in a similar manner as for making toner images in an adjacent image frame area, e.g., by charging, exposing, and developing with the toner of the first module. The composite toner patch image on the rotating photoconductor is moved past a preferably stationary optical detector and a signal, e.g., a control signal, is thereby generated. Similarly, each of the second, third, and fourth modules can have a respective composite toner patch image located in an interframe area on the corresponding photoconductor surface, i.e., for monitoring or measuring background toner deposition of toner particles having the same color as the color separation toner image of the respective module.

Thus in each of the modules, a respective composite toner patch image passes a respective detector so as to generate a respective signal for processing in a respective electronic circuit as described previously above. Output from this electronic circuit can be sent for example to a computer so as to for example generate a message for an operator of the machine, or activate a warning light. Or, the signal can be a control signal for controlling the set points of a subsystem in the module, e.g., for controlling the set points of a charging subsystem, an exposure subsystem, or a toning subsystem. In such a modular printer, any composite toner patch image, control toner image or reference toner image which is formed on a respective photoconductor can be transferred to the respective intermediate transfer member (not illustrated) for monitoring thereon by an optical detector, or can be transferred to the receiver member for monitoring on the receiver member by a suitable detector (see FIG. 6).

In general, for purpose of early detection of developer aging, it is preferred to monitor or measure background toner on an imaging member rather than on an intermediate transfer member or on a receiver member, so that weakly charged toner particles or wrong sign toner particles can be detected. On the other hand, after transfer to an intermediate transfer member or a receiver member, a composite toner patch image, control toner image, or reference toner image will tend to include primarily well charged toner particles, so that an increase of background density can be used as an indicator of photoconductor fatigue. It will be evident that a combined use of different embodiments, alternately or simultaneously, can at least in principle, render information relating independently to both developer aging and photoconductor fatigue.

A test image patch or a reference image patch for use in the invention can have locations at any suitable place on a toner-image-bearing member, which suitable place is preferably outside any image frame and more preferably situated in an interframe area as described above.

While the invention is primarily concerned with detection of a low coverage of background toner particles on a toner-image-bearing member, such as for example an electrostatographic imaging member or on an intermediate transfer member, the invention also envisages applications in which it is necessary to measure or monitor a low coverage of toner particles in general. For example, the invention can be extended to measure a surface coverage of residual toner particles left behind after a cleaning operation, i.e., to monitor the efficiency of a toner cleaning station for cleaning residual or non-transferred toner particles from the surface of a photoconductor roller or belt, or from an intermediate transfer roller or belt. Thus a control signal obtained by monitoring of a test patch area or of an image frame after passage of the test patch or image frame through a cleaning station can be used as a process control signal for changing operating set points, e.g., of the cleaning station itself, or to alter the set points of some other process station in the electrostatographic machine having relation to a cleaning operation. Moreover, in certain applications the invention can be used to measure cleaning efficiency.

As another example, the invention can be used in measuring transfer efficiency, i.e., to measure a residual toner coverage in a test pattern of spaced bars, e.g., on a member after transfer of toner from that member to another member. It is noteworthy that such a residual toner coverage is typically too low for accurate measurement by a conventional densitometer. A message or a control signal can be generated if for example the post-transfer residual toner density on the member exceeds a predetermined level.

As mentioned above, the invention can also be used to monitor low density toner levels on an intermediate transfer member, e.g., an intermediate transfer member such as an intermediate transfer roller included in a modular electrostatographic printing machine. Thus instead of measuring a low coverage of toner in an unfused test patch image on the photoconductor, the corresponding low-coverage toner image (or reference image as needed) can be measured on the surface of the respective intermediate transfer member after transfer thereto from the corresponding photoconductor.

In general, it is preferred to form on an imaging member a reference toner patch, a control toner patch, or a composite toner patch in sporadic fashion only. Since a primary purpose of the invention is to test for developer aging (or photoconductor fatigue) this can be done from time to time, e.g., after each time a prescribed number of prints has been generated by the electostatographic machine. In this way, contamination or scumming of interframe areas is minimized, inasmuch as a given interframe area where such a patch is located can be cleaned multiple times between each formation of a reference toner patch, control toner patch, or composite toner patch. However, an advantage of those embodiments of the invention that utilize synchronous detection is that this type of detection is relatively insensitive to at least small amounts of contamination.

In summary, this invention teaches apparatus and method for detecting and measuring faint depositions of toner resulting in almost imperceptible changes in reflectance or transmittance of a substrate. Moreover, it has been well-known to practitioners of the art that transfer efficiency is never 100% and that the efficiency of a cleaning station is rarely 100%. The invention includes scanning of an area from which a bar pattern was transferred so as to offer a transfer efficiency monitoring technique, and further includes scanning of an area from which a bar pattern was just cleaned so as to offer a technique for monitoring cleaning efficiency.

It will be evident that notwithstanding the above description, the invention is not limited to the applications described above and can be used in a wide variety of electrostatographic machines, including both color and black-and-white reproduction machines or printing machines.

According to the subject invention, a method for measuring a low coverage of toner particles on a toner-image-bearing member is provided for use in an electrostatographic machine. The toner-image-bearing member has thereon a toner image located in an image frame, the toner image including a background area in which a coverage of background toner particles may be present, and the toner-image-bearing member having thereon a non-image area, which non-image area is exclusive of the image frame, with the non-image area having thereon a control toner image and a reference toner image. A detector of the control toner image is provided for producing a control toner image signal, and a detector of the reference toner image provided for producing a reference toner image signal.

The aforementioned method includes the steps of: forming the control toner image in the non-image area on the toner-image-bearing member; forming the reference toner image in the non-image area on the toner-image-bearing member; moving in a certain direction the control toner image on the toner-image-bearing member past the detector for producing the control toner image signal; moving in the certain direction the reference toner image on the toner-image-bearing member past the detector for producing the reference toner image signal; wherein said control toner image includes toned control strips having a coverage substantially the same as the coverage of background toner particles in the image area on the toner-image-bearing member, the toned control strips being perpendicular to the certain direction; wherein the reference toner image includes toned reference strips having the reference toner coverage, the toned reference strips being perpendicular to the certain direction; wherein the control toner image signal is a control AC signal and the reference toner image signal is a reference AC signal; and wherein the control AC signal and the reference AC signal are processed in a synchronous detection circuit having a DC output, which DC output has an amplitude proportional to the control toner coverage.

In the above method, the control toner image and the reference toner image can be co-formed in a composite toner patch image in the non-image area on the toner-image-bearing member, the composite toner patch image including the toned control strips and the toned reference strips; and the control AC signal and the reference AC signal are included in a composite AC signal conducted to the synchronous detection circuit.

The invention has been described in detail with particular reference to certain preferred embodiments thereof, but it will be understood that variations and modifications can be effected within the spirit and scope of the invention.

What is claimed is:

1. An electrophotographic printing machine comprising:

an image-bearing member, having image frame areas for receiving developed images, said image frame areas separated by interframe areas;

a charger for forming a latent image on said image-bearing member; a development station containing toner particles for developing said latent image so as to create a toner image on said image-bearing member, said toner image being created in said image frame area on said image-bearing member for subsequent transfer of said toner image to a receiver member;

an optical detector for monitoring and measuring a low coverage of toner particles on said image-bearing member, said low coverage of toner particles relating to a background area of said toner image;

a signal produced by said optical detector, representative of the low coverage of toner particles on said image-bearing member; and a control device for controlling said electrophotographic printing machine when said low coverage of toner particles exceeds a certain coverage, said certain coverage including a threshold coverage and a pre-selected coverage.

2. An electrophotographic printing machine according to claim 1 wherein said low coverage of toner particles, relating to a background area of said toner image, monitored by said optical detector, is included in a control patch area on said imaging-bearing member, via toning of a control patch latent image by said development station, said control patch latent image toned by toner particles having a nature similar to said toner particles relating to said background area of said toner image, and said control patch area is located in an interframe area on said image-bearing member.

3. An electrophotographic printing machine according to claim 2, wherein said image-bearing member is movable so as to move said control patch latent image past said optical detector, and said development station toners said control patch latent image such that said control patch latent image includes a plurality of spaced toned strips, with said plurality of spaced toned strips being perpendicular to a direction of movement of said image-bearing member.

4. An electrophotographic printing machine according to claim 3, wherein said signal produced by detection of said plurality of spaced toned strips by said optical detector is a control AC signal.

5. An electrophotographic printing machine according to claim 4, wherein:

said control patch latent image is a plurality of mutually adjacent charged strips on said image-bearing member, said plurality of mutually adjacent charged strips being perpendicular to a direction of movement of said image-bearing member, each charged strip of said plurality of mutually adjacent charged strips having a predetermined width measured in said direction of movement of said image-bearing member;

said plurality of mutually adjacent charged strips include a first number of charged strips each of which has a first charge density, said first charge density at a level to produce in said development station a first development electric field in a direction so as to inhibit toning by nominally charged toner particles;

said plurality of mutually adjacent charged strips further include a second number of charged strips each of which has a second charge density, said second charge density at a level to produce in said development station a second development electric field in a direction so as to inhibit toning by nominally charged toner particles;

said first charge density and said second charge density have differing magnitudes;

said first number of charged strips and said second number of charged strips are mutually interleaved in alternating fashion, with associated electric fields there between; and said associated electric fields induce toning via dielectrophoretic forces so as to form said control toner image on said image-bearing member.

6. An electrophotographic printing machine according to claim 4, wherein said control device includes a synchronous detection circuit, and said control AC signal has a predetermined frequency, and wherein a reference AC signal, of a non-electrostatographic origin, is provided to said control device, said reference AC signal having a high signal-to-noise ratio and a reference frequency suitable for use with said predetermined frequency in a synchronous detection circuit, and said synchronous detection circuit produces a DC output having an amplitude proportional to said low coverage of toner particles.

7. An electrophotographic printing machine according to claim 4, further including a reference optical detector, and wherein said image-bearing member includes thereon a reference toner image formed in a reference patch area, via toning of a reference latent image by said development station, said reference patch area being located in an interframe area on said image-bearing member and is detected by said reference optical detector, said image-bearing member being movable to move said reference toner image past said reference optical detector so as to produce a reference signal, said reference toner image including a plurality of spaced toned reference strips perpendicular to a direction of movement of said image-bearing member, and said spaced toned reference strips of said reference toner image having a higher coverage of toner particles than said low coverage of toner particles.

8. An electrophotographic printing machine according to claim 7, wherein a reference AC signal results from detection by said reference optical detector of said plurality of spaced toned reference strips of said reference toner image.

9. An electrophotographic printing machine according to claim 8, wherein said control AC signal and said reference AC signal have a frequency in common and are substantially in phase one with the other.

10. An electrophotographic printing machine according to claim 9, wherein said control device further includes a signal-multiplying device, and said control AC signal and said reference AC signal are suitably filtered and multiplied in said signal-multiplying device so as to measure via synchronous detection a quantity proportional to said low coverage of toner particles.

11. An electrophotographic printing machine according to claim 1 wherein said low coverage of toner particles relating to said background area of said toner image is included in a composite toner patch image located in an interframe area on said image-bearing member; said composite toner patch image including a plurality of equally spaced toned strips, mutually parallel and perpendicular to a direction of movement of said image-bearing member; said plurality of equally spaced toned strips being inclusive of control toned strips and reference toned strips, said control toned strips having a lower coverage of toner than said reference-toned strips, said lower coverage substantially equal to said low coverage of toner particles relating to said background area of said toner image, said plurality of equally spaced toned strips further including a periodically repeating arrangement of strips, said periodically repeating arrangement of strips repeating adjacently in said direction of movement of said image-bearing member, said periodically repeating arrangement of strips including a reference toned strip and an integral number of control toned strips successively following said reference toned strip, with said integral number greater than or equal to 3; and said periodically repeating arrangement of strips having a lower frequency component from said reference-toned strips and a higher frequency component from said control toned strips.

12. An electrophotographic printing machine according to claim 11 wherein said composite toner patch image is moved with said image-bearing member in a direction past said optical detector, said signal produced by said optical detector is a composite AC signal inclusive of said lower frequency component and said higher frequency component; and wherein said control device further includes a synchronous detection circuit, said composite AC signal being divided and thereafter conducted into a control branch and a reference branch of said synchronous detection circuit, said reference branch suitably filtering said composite AC signal so as to leave said lower frequency component, said lower frequency component being passed through a frequency-multiplying device so as to produce a reference branch signal having a frequency substantially the same as said higher frequency component; said control branch suitably filtering said composite AC signal to leave said higher frequency component so as to produce a control branch signal, and said control branch signal and said reference branch signal being multiplied together in a signal-multiplying device, and the resulting multiplied signal being passed through a low pass filter so as to produce an output signal having a DC component, said DC component of a magnitude proportional to said low coverage of toner particles.

13. An electrophotographic printing machine according to claim 1, wherein, said toner image is a test image located in an image frame area on said receiver member, said test image including a color sub-image, said color sub-image included in a plurality of color sub-images, said color sub-image having a respective color; said color sub-image including a respective plurality of control strips having said respective color, said respective plurality of control strips having a respective post-transfer low coverage of toner particles after transfer to said receiver member, said respective post-transfer low coverage of toner particles relating to a respective background area on a toner image; said test image on said receiver member is moved with said receiver member at a steady rate past said optical detector, said respective plurality of control strips being perpendicular to a direction of movement of said receiver member; and wherein said color sub-image further includes a respective plurality of reference strips having said respective color, said respective plurality of reference strips having a respective post-transfer reference coverage of toner particles, said respective post-transfer reference coverage of toner particles being relatively high, said respective plurality of reference strips being perpendicular to said direction of movement of said receiver member; and wherein said control device further includes a synchronous detection circuit, and said signal produced by said optical detector is an AC signal which includes a plurality of control components having a control frequency, a respective control component included in said plurality of control components is produced via detection by said optical detector of said respective plurality of control strips, said respective control component having an amplitude proportional to said respective post-transfer low coverage of toner particles, said AC signal further including a plurality of reference components having a reference frequency, said reference frequency lower than said control frequency, a respective reference component included in said plurality of reference components is produced via detection by said optical detector of said respective plurality of reference strips, said respective reference component having an amplitude proportional to said respective post-transfer reference coverage, and said respective reference component and said respective control component are processed in said synchronous detection circuit, which synchronous detection circuit has an output proportional to said respective post-transfer low coverage of toner particles relating to said respective background area on said toned imaging member.

14. A method for measuring a low coverage of toner particles on an image-bearing member, said method for use in an electrostatographic machine, said image-bearing member having thereon a toner image located in an image frame, said toner image including a background area in which a coverage of background toner particles may be present, said image-bearing member having thereon a non-image area, said non-image area exclusive of said image frame, said non-image area having thereon a control toner image and a reference toner image, a detector of said control toner image being provided for producing a control toner image signal, a detector of said reference toner image provided for producing a reference toner image signal, said method including the steps of:

forming said control toner image in said non-image area on said image-bearing member, said control toner image including toned control strips, said toned control strips having a coverage substantially the same as said coverage of background toner particles in said image areas;

moving said control toner image, on said image-bearing member, in a given direction past said detector for producing said control toner image signal, said toned control strips being perpendicular to said given direction, wherein said control toner image signal is a control AC signal;

forming said reference toner image in said non-image area on said image-bearing member, said reference toner image including toned reference strips, said toned reference strips having said reference toner coverage;

moving said reference toner image, on said image-bearing member, in said given direction past said detector for producing said reference toner image signal, said toned reference strips being perpendicular to said given direction wherein said reference toner image signal is a reference AC signal; past said detector for producing said reference toner image signal; and processing said control AC signal and said reference AC signal in a synchronous detection circuit having a DC output, said DC output having an amplitude proportional to said control toner coverage.

15. The method of claim 14 wherein said control toner image and said reference toner image are co-formed in a composite toner patch image in said non-image area, said composite toner patch image including said toned control strips and said toned reference strips, and said control AC signal and said reference AC signal are included in a composite AC signal conducted to said synchronous detection circuit.

* * * * *